US010781571B2

(12) United States Patent
Fukuda et al.

(10) Patent No.: US 10,781,571 B2
(45) Date of Patent: Sep. 22, 2020

(54) HYDRAULIC SYSTEM FOR WORKING MACHINE

(71) Applicant: KUBOTA CORPORATION, Osaka (JP)

(72) Inventors: Yuji Fukuda, Osaka (JP); Keigo Honda, Osaka (JP); Yoshimitsu Tanaka, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/567,494

(22) Filed: Sep. 11, 2019

(65) Prior Publication Data

US 2020/0087891 A1 Mar. 19, 2020

(30) Foreign Application Priority Data

Sep. 13, 2018 (JP) ..... 2018-171757
Jan. 22, 2019 (JP) ..... 2019-008591

(51) Int. Cl.

| | |
|---|---|
| ***F15B 11/22*** | (2006.01) |
| ***E02F 9/22*** | (2006.01) |
| ***E02F 9/20*** | (2006.01) |
| ***E02F 3/42*** | (2006.01) |

(Continued)

(52) U.S. Cl.

CPC ..... *E02F 9/2225* (2013.01); *E02F 3/422* (2013.01); *E02F 3/433* (2013.01); *E02F 9/2004* (2013.01); *E02F 9/2267* (2013.01); *E02F 9/2271* (2013.01); *E02F 9/2275* (2013.01);

(Continued)

(58) Field of Classification Search

CPC ..... E02F 9/2004; E02F 3/433

See application file for complete search history.

(56) References Cited

U.S. PATENT DOCUMENTS 8,495,870 B2 * 7/2013 Sumiyoshi ..... E02F 9/2232 60/444
8,607,821 B2 * 12/2013 Miki ..... E02F 3/436 137/596.17

(Continued)

FOREIGN PATENT DOCUMENTS

JP 2010270527 12/2010
JP 2011208693 10/2011

*Primary Examiner* — Thomas E Lazo
(74) *Attorney, Agent, or Firm* — Greenblum & Bernstein, P.L.C.

(57) ABSTRACT

A hydraulic system includes first and second control valves controlling a flow rate of operation fluid to be supplied to first and second hydraulic actuators, respectively, a supply fluid tube connecting the first control valve and the second control valve and being connected to a return fluid tube, and a discharge fluid tube connected to the second control valve. The second control valve is switched between primary, secondary, and tertiary positions, the primary position blocking between the supply fluid tube and the discharge fluid tube and allowing return fluid to be supplied to the second hydraulic actuator, the secondary position communicating between the supply fluid tube and the discharge fluid tube and stopping supplying the return fluid to the second hydraulic actuator, and the tertiary position communicating between the supply fluid tube and the discharge fluid tube and allowing the return fluid to be supplied to the second hydraulic actuator.

20 Claims, 9 Drawing Sheets

(51) Int. Cl.
*E02F 3/43* (2006.01)
*E02F 3/28* (2006.01)

(52) U.S. Cl.
CPC ..... *E02F 9/2285* (2013.01); *F15B 11/22* (2013.01); *E02F 3/283* (2013.01); *E02F 9/2292* (2013.01)

(56) References Cited

U.S. PATENT DOCUMENTS

2017/0159265 A1* 6/2017 Tomita ..... E02F 9/2267
2017/0175779 A1* 6/2017 Fukuda ..... F15B 11/16

* cited by examiner

HYDRAULIC SYSTEM FOR WORKING MACHINE

CROSS-REFERENCE TO RELATED APPLICATIONS

The present application claims priority under 35 U.S.C. § 119 to Japanese Patent Application No. P2018-171757, filed Sep. 13, 2018 and to Japanese Patent Application No. P2019-008591, filed Jan. 22, 2019. The contents of these applications are incorporated herein by reference in their entirety.

BACKGROUND OF THE INVENTION

Field of the Invention

The present invention relates to a hydraulic system for a working machine and to a control valve.

Description of Related Art

A technique disclosed in Japanese Unexamined Patent Application Publication No. 2010-270527 is known as a hydraulic system for a working machine. The working machine disclosed in Japanese Unexamined Patent Application Publication No. 2010-270527 includes a boom, a bucket, a boom cylinder configured to move the boom, a bucket cylinder configured to move the bucket, an auxiliary actuator configured to operate an auxiliary attachment, a first control valve configured to control the stretching and shortening of the boom cylinder, a second control valve configured to control the stretching and shortening of the bucket cylinder, and a third control valve configured to operate the auxiliary actuator.

A technique disclosed in Japanese Unexamined Patent Application Publication No. 2011-208693 is known as a hydraulic system for a working machine. The hydraulic system disclosed in Japanese Unexamined Patent Application Publication No. 2011-208693 includes an unload passage connected to a hydraulic pump, a tank passage connected to a tank, a first directional switching valve connected to the unload passage and configured to control the supplying of pressured fluid from the hydraulic pump to a first actuator, a pair of first supply/discharge passages connecting between the first directional switching valve and the first actuator, a second directional switching valve connected to the unload passage on the downstream side from the first directional switching valve and configured to control the supplying of pressured fluid from the hydraulic pump to the second actuator, and a pair of second supply/discharge passages that connect between the second directional switching valve and the second actuator. In a multiple directional switching valve that returns the pressured fluid from the first supply/discharge passages to the unload passages when the first actuator is actuated, the first directional switching valve has a switching position where the unload passage on the upstream side of the first directional switching valve communicates with one end of the first supply/discharge passage and further where the other end of the first supply/discharge passage communicates with the tank passage and the unload passage on the downstream side of the first directional switching valve. A tank return passage is connected to the first directional switching valve, the tank return passage communicating between the other end of the first supply/discharge passage and the tank passage.

SUMMARY OF THE INVENTION

A hydraulic system for a working machine, includes: a hydraulic pump; a first hydraulic actuator, a second hydraulic actuator; a first control valve to control a flow rate of operation fluid to be supplied to the first hydraulic actuator; a second control valve to control a flow rate of operation fluid to be supplied to the second hydraulic actuator; a return fluid tube connecting the first control valve and the second control valve and allowing a return fluid to flow in the return fluid tube, the return fluid being operation fluid returning from the first hydraulic actuator to the first control valve; a supply fluid tube connecting the first control valve and the second control valve separately from the return fluid tube and being connected to the return fluid tube at a middle portion of the supply fluid tube; a discharge fluid tube connected to the second control valve; an operation member to operate the second control valve; and a controller to control the second control valve in accordance with operation of the operation member. The second control valve is switched between a primary position, a secondary position, and a tertiary position, the primary position blocking between the supply fluid tube and the discharge fluid tube and allowing the return fluid to be supplied to the second hydraulic actuator, the secondary position communicating between the supply fluid tube and the discharge fluid tube and stopping supplying the return fluid to the second hydraulic actuator, and the tertiary position communicating between the supply fluid tube and the discharge fluid tube and allowing the return fluid to be supplied to the second hydraulic actuator. The controller switches the second control valve to the primary position when the first control valve is under a non-operation state where operation fluid is not supplied to the first hydraulic actuator and when the operation member is at a first operating position, switches the second control valve to the secondary position when the first control valve is under the non-operation state and when the operation member is at a second operating position, and switches the second control valve to the tertiary position when the first control valve is under an operation state where operation fluid is supplied to the first hydraulic actuator and when the operation member is at the first operating position.

A hydraulic system for a working machine, includes: a hydraulic pump; a first hydraulic actuator; a second hydraulic actuator; a first control valve to control the first hydraulic actuator; a second control valve arranged on a downstream side of the first control valve, the second control valve being configured to control the second hydraulic actuator; a communication fluid tube in which a return fluid flows to the second control valve, the return fluid being operation fluid discharged from the first hydraulic actuator; a leveling control valve connected to the communication fluid tube, the leveling control valve being configured to perform a leveling operation of the second hydraulic actuator; a return discharge fluid tube to discharge the return fluid flowing toward the second control valve on a side closer to the second control valve than a portion on which the leveling control valve is arranged in the communication fluid tube.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
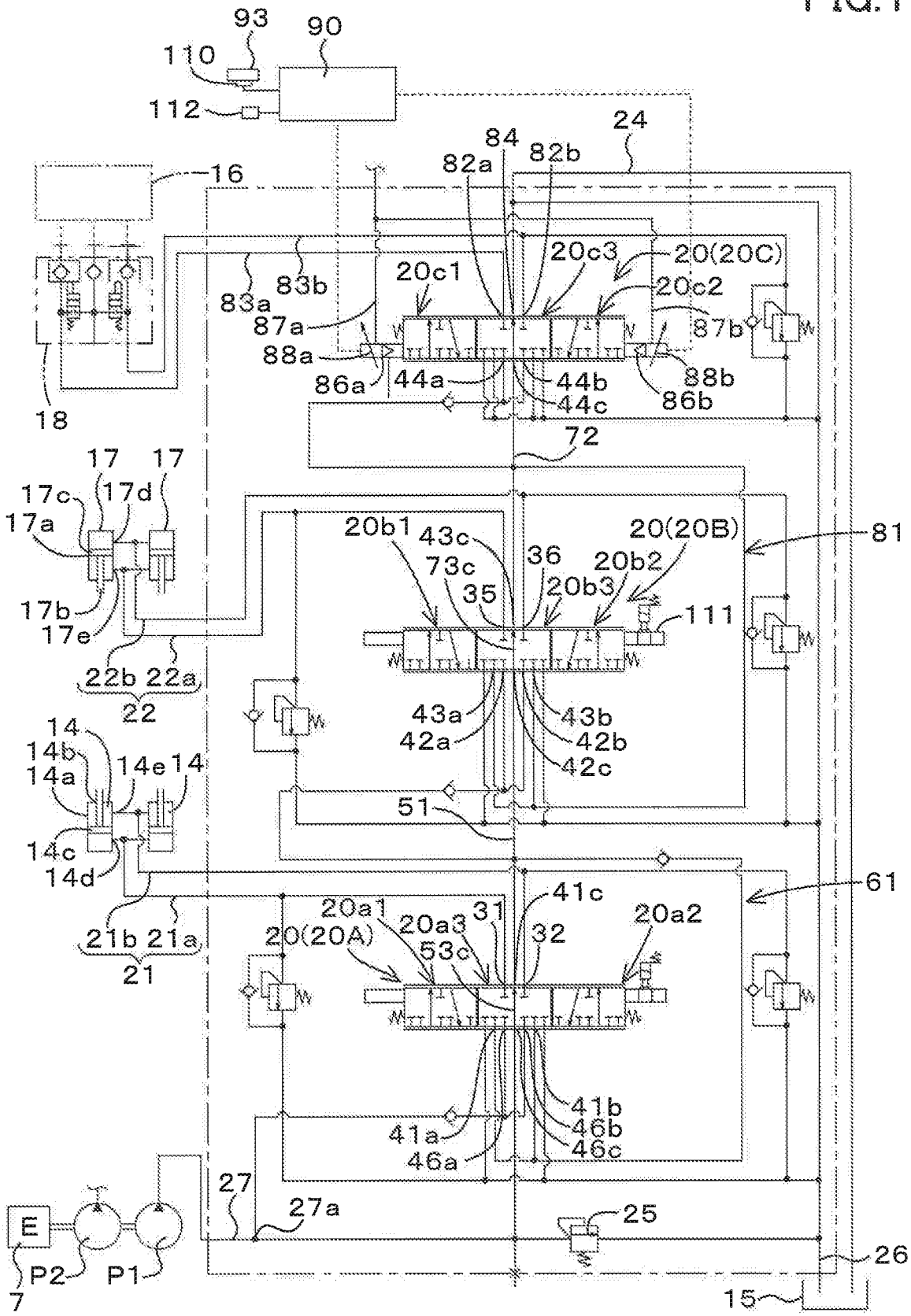
FIG. 1 is a view illustrating a hydraulic system (a hydraulic circuit) for a working machine according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

First Embodiment

Hereinafter, with reference to the drawings as appropriate, a hydraulic system for a working machine according to a first embodiment of the present invention and a working machine provided with the hydraulic system will be described.

Figure 6:
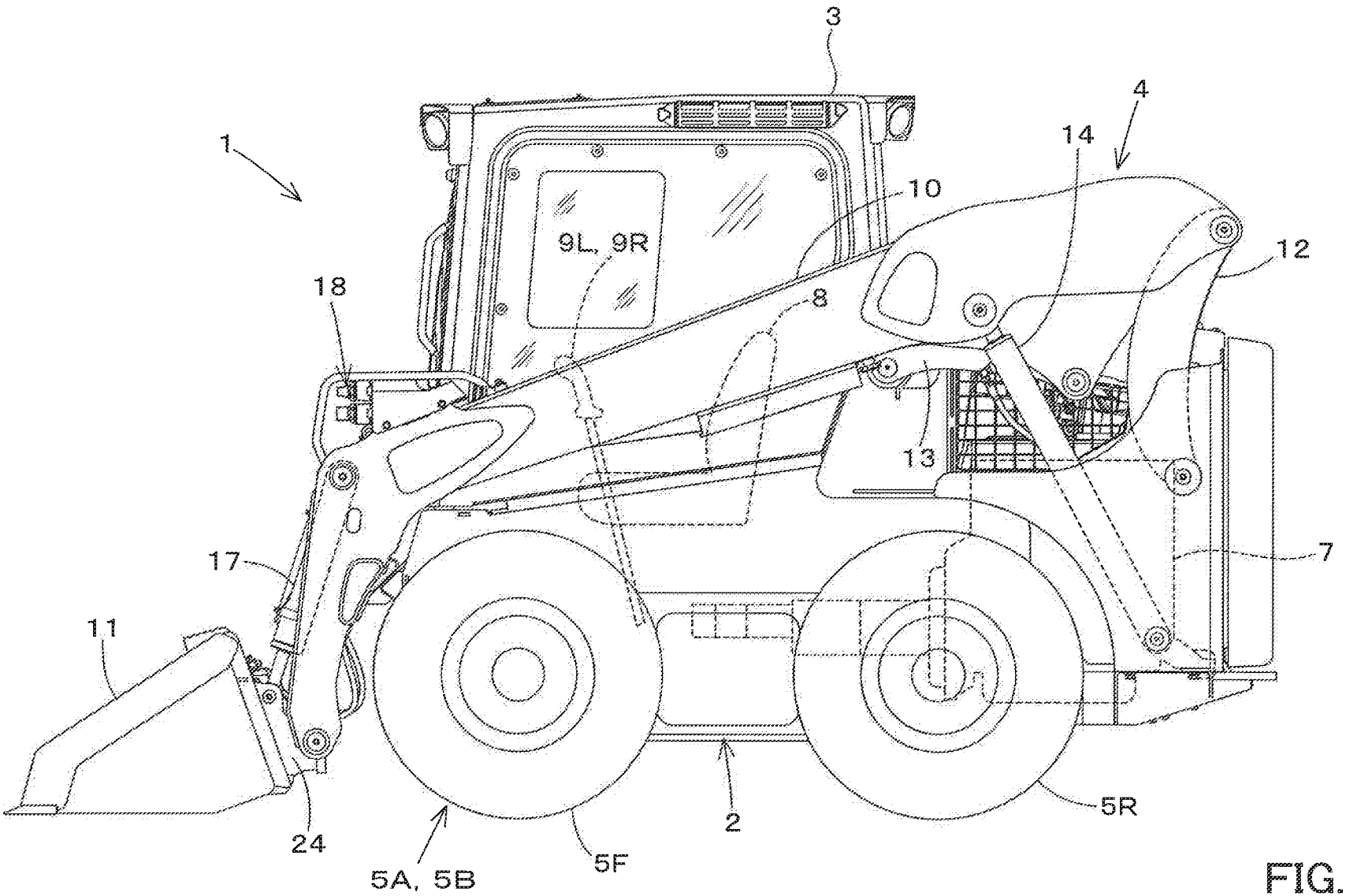
FIG. 6 is a whole view of a skid steer loader exemplified as the working machine according to the embodiments of the present invention.

First, the working machine will be described. FIG. 6 shows a side view of the working machine according to the present invention. In FIG. 6, a skid steer loader is shown as an example of the working machine.

However, the working machine according to the present invention is not limited to the skid steer loader, and may be another type of loader working machine such as a compact truck loader. Moreover, a working machine other than the loader working machine may be employed.

The working machine 1 includes a machine body (a vehicle body) 2, a cabin 3, a working device 4, and traveling devices 5A and 5B.

A cabin 3 is mounted on the machine body 2. An operator seat 8 is provided at the rear portion of the cabin 3.

In the embodiment of the present invention, the front side (the left side in FIG. 6) of the operator seated on an operator seat 8 of the working machine 1 will be described as the front, the rear side (the right side in FIG. 6) of the operator will be described as the rear, the left side (the front surface side of FIG. 6) of the operator will be described as the left, and the right side (the back surface side of FIG. 6) of the operator will be described as the right. In addition, the horizontal direction, which is a direction orthogonal to the front-rear direction, will be described as the machine width direction.

The direction extending from the center portion of the machine body 2 toward the right portion or the left portion will be described as the machine outward direction. In other words, the machine outward direction is the machine width direction and a direction separating away from the machine body 2.

The direction opposite to the machine outward direction will be described as the machine inward direction. In other words, the machine inward direction is the machine width direction and a direction approaching the machine body 2.

The cabin 3 is mounted on the machine body 2. The working device 4 is a device for the working, and is mounted on the machine body 2. The traveling device 5A is a device configured to travel the machine body 2, and is arranged on the left side of the machine body 2. The traveling device 5B is a device configured to travel the machine body 2, and is arranged on the right side of the machine body 2.

A prime mover 7 is arranged internally at the rear portion of the machine body 2. The prime mover 7 is a diesel engine (an engine). The prime mover 7 is not limited to the engine, and may be an electric motor or the like.

A traveling lever 9L is arranged on the left side of the operator seat 8. A traveling lever 9R is arranged on the right side of the driver seat 8. The traveling lever 9L arranged on the left operates the traveling device 5A arranged on the left, and the traveling lever 9R arranged on the right operates the traveling device 5B arranged on the right.

The working device 4 includes a boom 10, a bucket 11, a lift link 12, a control link 13, a boom cylinder 14, and a bucket cylinder 17. The boom 10 is arranged on the side of the machine body 2. The bucket 11 is arranged at the tip end (a front end) of the boom 10.

The lift link 12 and the control link 13 support the base portion (a rear portion) of the boom 10. The boom cylinder 14 moves the boom 10 up and down.

In particular, the lift link 12, the control link 13, and the boom cylinder 14 are arranged on the side of the machine body 2. The upper portion of the lift link 12 is pivotally supported by the upper portion of the base portion of the boom 10. The lower portion of the lift link 12 is pivotally supported on the side portion of the rear portion of the machine body 2.

The control link 13 is arranged in front of the lift link 12. One end of the control link 13 is pivotally supported by the lower portion of the base portion of the boom 10, and the other end of the control link 13 is pivotally supported by the machine body 2.

The boom cylinder 14 is a hydraulic cylinder configured to lift and lower the boom 10. The upper portion of the boom cylinder 14 is pivotally supported by the front portion of the base portion of the boom 10. The lower portion of the boom cylinder 14 is pivotally supported by the side portion of the rear portion of the machine body 2. When the boom cylinder 14 is stretched and shortened, the boom 10 is swung up and down by the lift link 12 and the control link 13.

The bucket cylinder 17 is a hydraulic cylinder configured to swing the bucket 11. The bucket cylinder 17 couples the left portion of the bucket 11 and the boom arranged to the left, and couples the right portion of the bucket 11 and the boom arranged to the right.

In addition, instead of the bucket 11, a auxiliary attachment such as a hydraulic crusher, a hydraulic breaker, an angle broom, an auger, a pallet fork, a sweeper, a mower, a snow blower, or the like, is attached to the tip end (a front portion) of the boom 10.

In the present embodiment, wheel type traveling devices 5A and 5B having front wheels 5F and rear wheels 5R are employed as the traveling devices 5A and 5B. Note that crawler type (including semi-crawler type) traveling devices 5A and 5B may be employed as the traveling devices 5A and 5B.

Next, a working system hydraulic circuit (working system hydraulic system) provided in the skid steer loader 1 will be explained below.

The working system hydraulic system is a system for operating the boom 10, the bucket 11, the auxiliary attachment, and the like. As shown in FIG. 1, the working system hydraulic system includes a plurality of control valves 20 and a hydraulic pump (a first hydraulic pump) P1 for the working system. In addition, the working system hydraulic system includes a second hydraulic pump P2 other than the first hydraulic pump P1.

The first hydraulic pump P1 is a pump configured to be operated by the power of the prime mover 7, and is constituted of a fixed capacity gear pump (a constant displacement gear pump). The first hydraulic pump P1 is configured to output the operation fluid stored in the tank (a operation fluid tank) 15.

The second hydraulic pump P2 is a pump configured to be operated by the power of the prime mover 7, and is constituted of a fixed capacity gear pump (a constant displacement gear pump). The second hydraulic pump P2 is configured to output the operation fluid stored in the tank (the operation fluid tank) 15.

The second hydraulic pump P2 outputs the operation fluid for signals and the operation fluid for the controlling in the hydraulic system. The operation fluid for signals and the operation fluid for the controlling are called the pilot fluid.

The plurality of control valves 20 are valves for controlling various types of the hydraulic actuators provided in the working machine 1. The hydraulic actuator is a device configured to be operated with the operation fluid, such as a hydraulic cylinder and a hydraulic motor. In this embodiment, the plurality of control valves 20 includes a boom control valve 20A, a bucket control valve 20B, and an auxiliary control valve 20C.

The boom control valve 20A is a valve configured to control the hydraulic actuator (the boom cylinder) 14 for operating the boom 10. The boom control valve 20A is a three-position switching valve having a direct acting spool.

The boom control valve 20A is switched between a neutral position 20*a*3, a first position 20*al* other than the neutral position 20*a*3, and a second position 20*a*2 other than the neutral position 20*a*3 and the first position 20*al*. In the boom control valve 20A, the switching between the neutral position 20*a*3, the first position 20*al*, and the second position 20*a*2 are performed by movement of the spool through operation of the operation member.

The boom control valve 20A is switched by the spool moved directly through manual operation of the operation member. However, the spool may be moved through the hydraulic operation (the hydraulic operation using a pilot valve, and the hydraulic operation using a proportional valve). In addition, the spool may be moved through the electric operation (the electric operation magnetizing a solenoid). Moreover, the spool may be moved through other methods.

The boom control valve 20A and the first hydraulic pump P1 are coupled by a output fluid tube 27. A fluid tube 26 connected to the operation fluid tank 15 is connected to a section of the output fluid tube 27 between the boom control valve 20A and the first hydraulic pump P1.

A relief valve (a main relief valve) 25 is arranged in the middle portion of the fluid tube 26. The operation fluid outputted from the first hydraulic pump P1 flows through the output fluid tube 27 and is supplied to the boom control valve 20A.

In addition, the boom control valve 20A and the boom cylinder 14 are connected by a fluid tube 21.

In particular, the boom cylinder 14 includes a cylinder body 14*a*, a rod 14*b* arranged movably in the cylinder body 14*a*, and a piston 14*c* arranged on the rod 14*b*. A first port 14*d* through which the operation fluid is supplied and discharged is arranged at the base end portion of the cylinder body 14*a* (on the side opposite to the rod 14*b* side). A second port 14*e* through which the operation fluid is supplied and discharged is arranged at the tip end portion (on the rod 14*b* side) of the cylinder body 14*a*.

The fluid tube 21 includes a fluid tube 21*a* that connects the first port 31 of the boom control valve 20A and the first port 14*d* of the boom cylinder 14, and a fluid tube 21*b* that connects the second port 32 of the boom control valve 20A and the second port 14*e* of the boom cylinder 14.

Thus, when the boom control valve 20A is set to the first position (a lifting position) 20*al*, the operation fluid can be supplied from the fluid tube 21*a* to the first port 14*d* of the boom cylinder 14. In addition, the operation fluid can be discharged from the second port 14*e* of the boom cylinder 14 to the fluid tube 21*b*. In this manner, the boom cylinder 14 is stretched and the boom 10 is lifted.

When the boom control valve 20A is set to the second position (a lowering position) 20*a*2, the operation fluid can be supplied from the fluid tube 21*b* to the second port 14*e* of the boom cylinder 14. In addition, the operation fluid can be discharged from the first port 14*d* of the boom cylinder 14 to the fluid tube 21*a*. In this manner, the boom cylinder 14 is shortened and the boom 10 is lowered.

The bucket control valve 20B is a valve configured to control a hydraulic cylinder (a bucket cylinder) 17 for controlling the bucket 11. The bucket control valve 20B is a three-position switching valve having a pilot-type direct acting spool. The bucket control valve 20B is switched between a neutral position 20*b*3, a first position 20*b*1 other than the neutral position 20*b*3, and a second position 20*b*2 other than the neutral position 20*b*3 and the first position 20*b*1.

In the bucket control valve 20B, the switching between the neutral position 20*b*3, the first position 20*b*1, and the second position 20*b*2 is performed by manual movement of the operation member 111 such as a lever.

The bucket control valve 20B is switched by directly moving the spool through the manual operation of the operation member. However, the spool may be moved through the hydraulic operation (the hydraulic operation by a pilot valve, the hydraulic operation by a proportional valve). In addition, the spool may be moved through the electric operation (the electric operation by magnetization of a solenoid). Moreover, the spool may be moved by other methods.

The bucket control valve 20B and the bucket cylinder 17 are connected by a fluid tube 22. In particular, the bucket cylinder 17 includes a cylinder body 17*a*, a rod 17*b* movably arranged on the cylinder body 17*a*, and a piston 17*c* arranged on the rod 17*b*. A first port 17*d* through which the operation fluid is supplied and discharged is arranged at the base end portion of the cylinder body 17*a* (on the side opposite to the rod 17*b* side). A second port 17*e* through which the operation fluid is supplied and discharged is arranged at the tip end of the cylinder body 17*a* (on the rod 17*b* side).

The fluid tube 22 includes a communication fluid tube 22*a* that connects the first port 35 of the bucket control valve 20B and the second port 17*e* of the bucket cylinder 17, and a communication fluid tube 22*b* that connects a second port 36 of the bucket control valve 20B and a first port 17*d* of the bucket cylinder 17.

Thus, when the bucket control valve 20B is set to the first position (a shoveling position) 20*b*1, the operation fluid can be supplied from the communication fluid tube 22*a* to the second port 17*e* of the bucket cylinder 17. In addition, the operation fluid can be discharged from the first port 17*d* of the bucket cylinder 17 to the communication fluid tube 22*b*. In this manner, the bucket cylinder 17 is shortened, and the bucket 11 performs the shoveling operation.

In addition, when the bucket control valve 20B is set to the second position (a dumping position) 20*a*2, the operation fluid can be supplied from the communication fluid tube 22*b* to the first port 17*d* of the bucket cylinder 17. In addition, the operation fluid can be discharged from the second port 17*e* of the bucket cylinder 17 to the communication fluid tube 22*a*. In this manner, the bucket cylinder 17 is stretched, and the bucket 11 performs the dumping operation.

The auxiliary control valve 20C is a valve configured to control an auxiliary attachment, that is, a hydraulic actuator (a hydraulic device such as a hydraulic cylinder and a hydraulic motor) 16 mounted on the working tool. The auxiliary control valve 20C is a three-position switching valve having a pilot-type direct-acting spool. The auxiliary control valve 20C has a first input port 44*a*, a second input port 44*b*, and a third input port 44*c*.

A return fluid tube 81 to be described below is connected to the first input port 44 and the second input port 44*b*, which are first supply ports, and the operation fluid in the return fluid tube 81 is supplied. A center fluid tube (a supply fluid tube) 72, which will be described below, is connected to the third input port 44*c*, which is a second supply port, and the operation fluid in the center fluid tube 72 is supplied.

The auxiliary control valve 20C has a first output port 82*a* and a second output port 82*b*. A supply/discharge fluid tube 83*a* and a supply/discharge fluid tube 83*b* are connected to the first output port 82*a* and the second output port 82*b* which are output ports.

A connecting member 18 is connected to the supply/discharge fluid tube 83*a* and the supply/discharge fluid tube 83*b*, and a fluid tube connected to the hydraulic actuator 16 of the auxiliary attachment is connected to the connecting member 18. That is, the output ports (the first output port 82*a* and the second output port 82*b*) communicate with the hydraulic actuator 16.

The auxiliary control valve 20C has a discharge port 84. The discharge fluid tube 24 is connected to the discharge port 84. The discharge fluid tube 24 is a fluid tube for discharging the operation fluid to a discharge portion such as the operation fluid tank 15, and extends toward the operation fluid tank 15.

The auxiliary control valve 20C is switched between a neutral position 20*c*3, a first position 20*c*1 other than the neutral position 20*c*3, and a second position 20*c*2 other than the neutral position 20*c*3 and the first position 20*c*1.

When the auxiliary control valve 20C is in the first position 20*c*1, the first input port 44*a* and the first output port 82*a* are communicated with each other, and the path between the third input port 44*c* and the discharge port 84 is closed.

When the auxiliary control valve 20C is in the second position 20*c*2, the second input port 44*b* and the second output port 82*b* are communicated with each other, and the path between the third input port 44*c* and the discharge port 84 is closed.

That is, in the operation position (the first position 20*c*1, the second position 20*c*2), the auxiliary control valve 20C communicates the first supply port (the first input port 44*a*, the second input port 44*b*) and the output port (the first output port 82*a* and the second output port 82*b*), and block the path between the second supply port (the third input port 44*c*) and the discharge port 84.

In the neutral position (the stop position) 20*c*3, the auxiliary control valve 20C blocks the path between the first supply port (the first input port 44*a*, the second input port 44*b*) and the output port (the first output port 82*a*, the second output port 82*b*), and opens the path between the second supply port (the third input port 44*c*) and the discharge port 84.

The auxiliary control valve 20C has pressure receiving portions 86*a* and 86*b* configured to receive a pressure of the pilot fluid. The pressure receiving portions 86*a* and 86*b* are respectively connected to pilot fluid tubes 87*a* and 87*b*. In addition, the pilot fluid tubes 87*a* and 87*b* are connected to the second hydraulic pump P2.

The pressure receiving portions 86*a* and 86*b* respectively incorporate proportional valves 88*a* and 88*b*, and the pressure of the operation fluid [a pressure of the pilot fluid (a pilot pressure)] applied to the pressure receiving portions 86*a* and 86*b* can be changed by the proportional valves 88*a* and 88*b*.

In particular, the proportional valves 88*a* and 88*b* are electromagnetic valves whose opening aperture can be changed through magnetization. When the opening apertures of the proportional valves 88*a* and 88*b* are changed, the pilot pressure applied to the pressure receiving portions 86*a* and 86*b* of the auxiliary control valve 20C changes. In this manner, the spool of the auxiliary control valve 20C moves in an arbitrary direction.

For example, when the proportional valve 88*a* is opened, the pilot fluid is applied to the pressure receiving portion 86*a* of the auxiliary control valve 20C, and the pilot pressure applied to (acting on) the pressure receiving portion 86*a* is determined by the opening aperture of the proportional valve 88*a*. When the pilot pressure applied to the pressure receiving portion 86*a* exceeds a predetermined value, the spool of the auxiliary control valve 20C moves from the neutral position 20*c*3 to the first position 20*c*1 side.

In addition, when the proportional valve 88*b* is opened, the pilot fluid is applied to the pressure receiving portion 86*b* of the auxiliary control valve 20C, and the pilot pressure applied to (acting on) the pressure receiving portion 86*b* is determined by the opening aperture of the proportional valve 88*b*.

When the pilot pressure applied to the pressure receiving portion 86*b* becomes equal to or higher than a predetermined value, the spool of the auxiliary control valve 20C moves from the neutral position 20*c*3 to the second position 20*c*2 side.

The magnetization of the proportional valves 88*a* and 88*b* is performed by the control device 90. The control device 90 is constituted of a CPU and the like. An operation member 93 is connected to the control device 90. An operation amount (for example, a sliding amount, a swinging amount, or the like) of the operation member 93 is inputted to the control device 90.

The operation member 93 is constituted of, for example, a seesaw type switch that can be swung, a slide type switch that can be slid, or a push type switch that can be pressed.

When the operation member 93 is operated in one direction, an operation amount (a first operation amount) in one direction is input to the control device 90, and the control device 90 changes the opening aperture of the proportional valve 88*a* in accordance with the first operation amount.

In addition, when the first operation amount is the maximum, the opening aperture of the proportional valve 88*a* is the maximum. In addition, when the first operation amount is the minimum, the opening aperture of the proportional valve 88*a* is the minimum. That is, the first operation amount is substantially proportional to the opening aperture of the proportional valve 88*a*.

When the operation member 93 is operated in the other direction, the operation amount (a second operation amount) in the other direction is inputted to the control device 90, and the control device 90 changes the opening aperture of the proportional valve 88*b* in accordance with the second operation amount.

In addition, when the second operation amount is the maximum, the opening aperture of the proportional valve 88*b* is the maximum. In addition, when the second operation amount is the minimum, the opening aperture of the proportional valve 88*b* is the minimum. That is, the second operation amount is substantially proportional to the opening of the second proportional valve 60B.

The operation amount (the first operation amount, the second operation amount) of the operation member 93 can be detected by the operation detector device 110 that detects the swinging amount of the operation member 93 and the like. The operation detector device 110 is constituted of, for example, a potentiometer.

As described above, according to the hydraulic system for the working machine, the opening apertures of the proportional valves 88*a* and 88*b* can be set through the operation of the operation member 93. In addition, when the spool of the auxiliary control valve 20C is moved, the flow rate of the operation fluid supplied to the auxiliary actuator can be changed.

That is, when the auxiliary control valve 20C is set to the first position 20*c*1, the operation fluid can be supplied from the supply/discharge fluid tube 83*a* to the hydraulic actuator 16 of the auxiliary attachment.

When the auxiliary control valve 20C is set to the second position 20*c*2, the operation fluid can be supplied from the supply/discharge fluid tube 83*b* to the hydraulic actuator 16 of the auxiliary attachment.

In this manner, the operation fluid is supplied to the hydraulic actuator 16 from the supply/discharge fluid tube 83*a* or the supply/discharge fluid tube 83*b*, and thereby the hydraulic actuator 16 (the auxiliary attachment) can be operated.

Meanwhile, a series circuit (a series fluid tube) is employed in the hydraulic system. In the series circuit, the operation fluid returned from the hydraulic actuator to the control valve arranged on an upstream side can be supplied to the control valve arranged on a downstream side.

For example, focusing on the bucket control valve 20B and the auxiliary control valve 20C, the bucket control valve 20B is a control valve arranged on an upstream side, and the auxiliary control valve 20C is a control valve arranged on downstream side.

Hereinafter, the control valve arranged on an upstream side is referred to as a "first control valve", and the control valve arranged on a downstream side is referred to as a "second control valve". A control valve other than the first control valve and the second control valve and arranged on the downstream side of the second control valve is referred to as a "third control valve".

In addition, the hydraulic actuator corresponding to the first control valve is referred to as a "first hydraulic actuator". The hydraulic actuator corresponding to the second control valve is referred to as a "second hydraulic actuator". The hydraulic actuator corresponding to the third control valve is referred to as a "third hydraulic actuator". A fluid tube that supplies the return fluid, which is the operation fluid returning from the first hydraulic actuator to the first control valve, to the second control valve is referred to as a "first fluid tube".

In the embodiment, the bucket control valve 20B is the "first control valve". The auxiliary control valve 20C is the "second control valve". The boom control valve 20A is the "third control valve". In addition, the bucket cylinder 17 is the "first hydraulic actuator". The hydraulic actuator 16 of the auxiliary attachment is the "second hydraulic actuator". The boom cylinder 14 is the "third hydraulic actuator".

First, the boom control valve 20A will be described below.

The third control valve 20A and the output portion of the first hydraulic pump P1 are connected by an output fluid tube 27. The output fluid tube 27 is branched at a middle portion 27*a*. The branched fluid tube of the output fluid tube 27 is connected to the first input port 46*a* and the second input port 46*b* of the third control valve 20A. In addition, the output fluid tube 27 is connected to the third input port 46*c* of the third control valve 20A.

In this manner, the operation fluid outputted from the first hydraulic pump P1 is supplied into the third control valve 20A through the output fluid tube 27, the first input port 46*a*, the second input port 46*b*, and the third input port 46*c*.

The third control valve 20A and the first control valve 20B are coupled by a center fluid tube 51. The center fluid tube 51 couples the third output port 41*c* of the third control valve 20A and the third input port 42*c* of the first control valve 20B.

When the third control valve 20A is set to the neutral position 20*a*3, by the communication of the center fluid tube 53*c* connecting the third input port 46*c* and the third output port 41*c*, the supplied fluid that is the operation fluid supplied from the output fluid tube 27 to the third control valve 20A is supplied to the center fluid tube 51 through the third control valve 20A.

The third control valve 20A and the first control valve 20B are connected by a fluid tube 61 separately from the center fluid tube 51. The fluid tube 61 is a fluid tube allowing the return fluid that returning from the third hydraulic actuator 14 to the third control valve 20A to flow through the third control valve 20A, and the fluid tube supplies the return fluid to the first control valve 20B.

The fluid tube 61 connects the first output port 41*a* of the third control valve 20A and the first input port 42*a* of the first control valve 20B, and connects the second output port 41*b* of the third control valve 20A and the second input port 42*b* of the first control valve 20B. A middle portion of the fluid tube 61 is connected to the center fluid tube 51.

According to the above configuration, when the third control valve 20A is set to the second position 20*a*2, the supply fluid introduced into the second input port 46*b* flows through the second port 32 and the fluid tube 21*b*, and enters the second port 14*e* of the third hydraulic actuator 14.

When the supply fluid is supplied to the second port 14*e*, the third hydraulic actuator 14 is shortened, for example.

When the third hydraulic actuator 14 is shortened, the return fluid discharged from the first port 14*d* of the third hydraulic actuator 14 flows to the third control valve 20A through the fluid tube 21*a*. The return fluid in the third control valve 20A flows toward the first control valve 20B through the fluid tube 61.

Thus, the return fluid in the third hydraulic actuator 14 can be supplied to the first control valve 20B.

Next, the relation between the first control valve 20B and the second control valve 20C will be described in detail.

The first control valve 20B and the second control valve 20C are connected by a center fluid tube (a supply fluid tube) 72. The supply fluid tube 72 connects the third output port 43*c* of the first control valve 20B and the third input port (the second supply port) 44*c* of the second control valve 20C.

Thus, when the first control valve 20B is set to the neutral position 20*b*3, the supply fluid that is the operation fluid supplied to the first control valve 20B flows through the center fluid tube 73*c* that connects the third input port 42*c* and the third output port 43*c*, and is supplied to the supply fluid tube 72 connected to the third output port 43*c*.

The first control valve 20B and the second control valve 20C are connected by a return fluid tube 81 separately from the supply fluid tube 72. The return fluid tube 81 is a fluid tube that supplies, to the second control valve 20C, the return fluid returning from the first hydraulic actuator 17 to the first control valve 20B.

In particular, one end of the fluid tube 81 is connected to the first input port 44*a* of the second control valve 20C and the second input port 44*b*. In addition, the other end of the return fluid 81 is connected to the first output port 43*a* of the first control valve 20B and the second output port 43*b*.

The supply fluid tube 72 is confluent with the middle portion of the return fluid tube 81, and thereby the return fluid tube 81 and the supply fluid tube 72 communicate with each other.

According to the above configuration, when the first control valve 20B is set to the second position 20*b*2, the supply fluid introduced to the second input port 42*b* flows through the second port 36 and the communication fluid tube 22*b*, and enters the first port 17*d* of the first hydraulic actuator 17. When the supply fluid is supplied to the first port 17*d*, the first hydraulic actuator 17 is stretched, for example.

When the first hydraulic actuator 17 is stretched, the return fluid discharged from the second port 17*e* of the first hydraulic actuator 17 flows to the return fluid tube 81*a* through the communication fluid tube 22*a*, and the return fluid in the return fluid tube 81*a* flows toward the second control valve 20C.

Thus, the return fluid in the first hydraulic actuator 17 can be supplied to the second control valve 20C.

When the second control valve 20C is in the first position 20*c*1, the second control valve 20C supplies the return fluid in the first hydraulic actuator 17 to the second hydraulic actuator 16 to communicate the path between the first input port 44*a* and the first output port 82*a*.

Also when the second control valve 20C is in the second position 20*c*2, the second control valve 20C supplies the return fluid in the first hydraulic actuator 17 to the second hydraulic actuator 16 to communicate the path between the second input port 44*b* and the second output port 82*b*.

That is, when the second control valve 20C is in the operation position (the first position 20*c*1, the second position 20*c*2), the return fluid can be supplied to the second hydraulic actuator 16.

In addition, the second control valve 20C blocks the path between the second supply port (the third input port 44*c*) and the discharge port 84 in both the first position 20*c*1 and the second position 20*c*2. Thus, the center fluid tube (the supply fluid tube) 72 is blocked from the discharge fluid tube 24.

When the auxiliary control valve 20C is in the stop position 20*c*3, the auxiliary control valve 20C closes off the path between the first input port 44*a* and the first output port 82*a* and the path between the second input port 44*b* and the second output port 82*b*. Thus, the return fluid is not supplied to the second hydraulic actuator 16.

In addition, when the auxiliary control valve 20C is in the stop position 20*c*3, the auxiliary control valve 20C opens the path between the second supply port (the third input port 44*c*) and the discharge port 84. Thus, the central fluid tube (the supply fluid path) 72 and the discharge fluid tube 24 communicate with each other.

In the hydraulic system for the working machine, the operation of the second control valve 20C is changed in accordance with the operation of the first control valve 20B.

Figure 2:
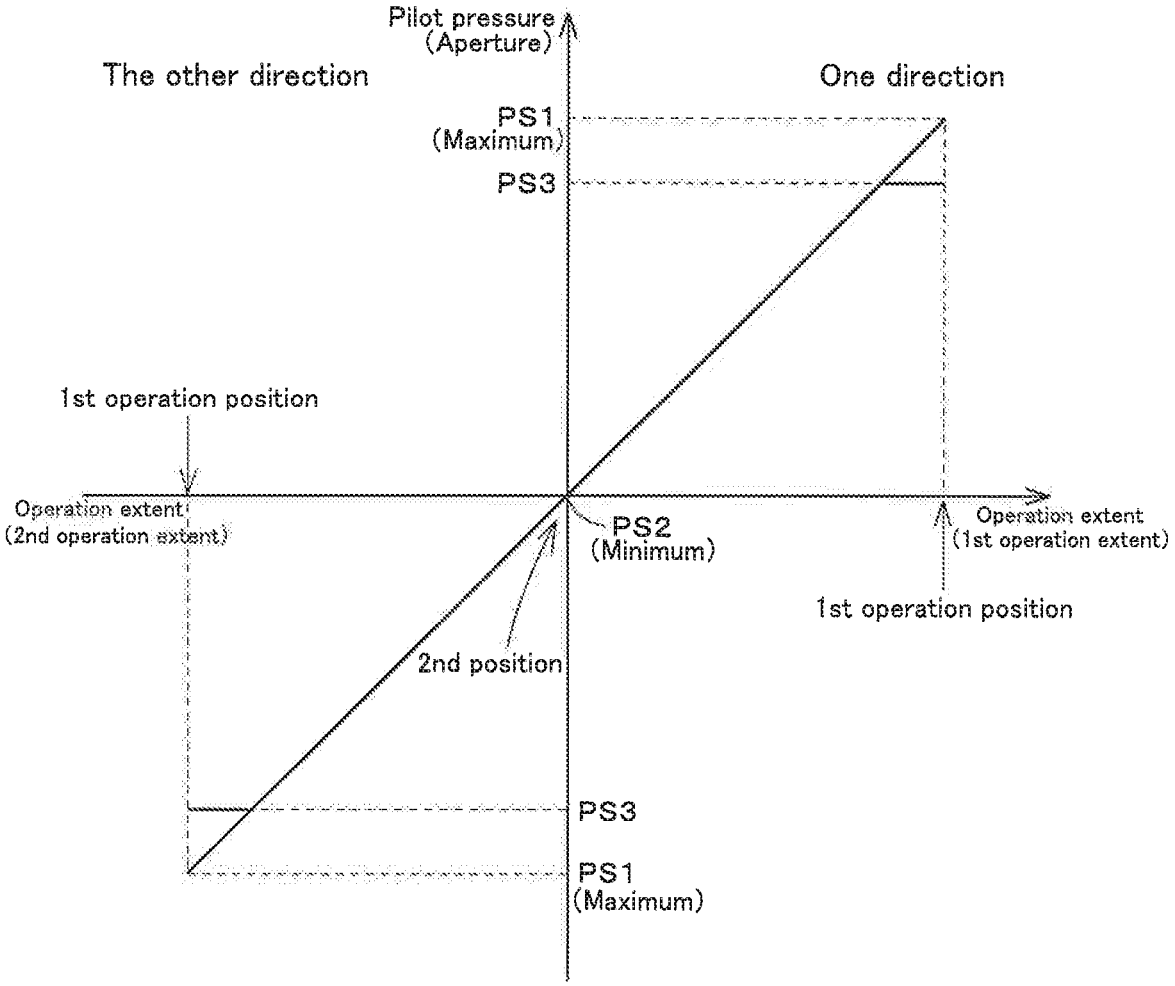
FIG. 2 is a view illustrating a relation between a pilot pressure and an operation extent (a position) of an operation member according to the first embodiment.

FIG. 2 shows the relation between the operation amount (a position) of the operation member 93 and the pilot pressure applied to the pressure receiving portions 86*a* and 86*b* of the second control valve 20C.

The pilot pressure applied to the pressure receiving portions 86*a* and 86*b* of the second control valve 20C can be replaced with the opening apertures of the proportional valves 88*a* and 88*b*. That is, the pilot pressure may be replaced with the electric current outputted from the control device 90 to the solenoids of the proportional valves 88*a* and 88*b*.

Thus, for convenience of the explanation, the explanation may be made with use of the opening apertures (the current values) of the proportional valves 88*a* and 88*b* instead of the pilot pressure applied to the pressure receiving portions 86*a* and 86*b* of the second control valve 20C.

As shown in FIG. 2, when the operation member 93 is gradually operated in one direction from the neutral state, the pilot pressure (the opening aperture, the current value) gradually increases in accordance with the operation amount of the operation member 93.

In addition, when the operation member 93 is gradually operated in the other direction from the neutral state, the pilot pressure (the opening aperture, the current value) gradually increases in accordance with the operation amount of the operation member 93. That is, the operation amount of the operation member 93 is proportional to the pilot pressure (the opening aperture, the current value).

Referring to FIG. 1 and FIG. 2, the operation of the second control valve 20C in a non-operation state in which the first control valve 20B stops supplying the operation fluid to the first hydraulic actuator 17 will be described below.

The non-operation state is a state where the operation fluid for stretching and shortening the first hydraulic actuator 17 is not substantially outputted from the first control valve 20B when the first control valve 20B is in the neutral position 30*b*3, in other words, when the first control valve 20B is not switched to one of the first position 20*b*1 and the second position 20*b*2.

The state whether or not the first control valve 20B is in the non-operation state can be detected by the state detector device 112 connected to the control device 90.

The state detector device 112 is, for example, a potentiometer that detects the position of the operation member 111 for operating the first control valve 20B, and detects the non-operation state when the position of the operation member 111 is a position that corresponds to the neutral position 30*b*3.

The state detector device 112 is an example, and the state whether or not the first control valve 20B is in the non-operation state may be detected through movement of the spool of the first control valve 20B. In addition, the state may be detected based on the pilot pressure applied to the pressure receiving portion when the first control valve 20B is configured to be switched by the pilot pressure applied to the pressure receiving portion. In addition, when the first control valve 20B is switched by an electric operation, the state may be detected through an electric signal outputted to the first control valve 20B.

As shown in FIG. 2, it is assumed that the operating member 93 is operated in one direction or the other direction in a state where the first control valve 20B is in the non-operation state. Here, when the first operation amount of the operation member 93 detected by the operation detector device 110 is the maximum value, the control device 90 maximizes the opening aperture of the proportional valve 88*a*, that is, the second control valve 20C is set to the first position 20*c*1 by setting the pressure applied to the pressure receiving portion 86*a* to the first pressure PS1 that is the highest pressure.

In addition, when the second operation amount of the operation member 93 detected by the operation detector device 110 is the maximum value, the control device 90 maximizes the opening aperture of the proportional valve 88*b*. That is, the control device 90 sets the second control valve 20C to the second position 20*c*2 by setting the pressure applied to the pressure receiving portion 86*b* to the first pressure PS1 that is the highest pressure.

That is, the control device 90 detects that either the first operation amount or the second operation amount of the operation member 93 is the maximum with the operation detector device 110 in a state where the first control valve 20B is in the non-operation state. Thus, when it is determined that the operation member 93 is at the first operating position (the position where the first operation amount reaches the maximum, the position where the second operation amount reaches the maximum) at which the operation member 93 has been fully strokes, the second control valve 20C is set to the operation position (the first position 20*c*1, the second position 20*c*2).

When the operation amount of the operation member 93 detected by the operation detector device 110 is the minimum value under the state where the first control valve 20B is in the non-operation state, the control device 90 minimizes the opening aperture of the proportional valve 88*a*. That is, the control device 90 sets the pilot pressure applied to the pressure receiving portions 86*a* and 86*b* to the second pressure PS2 that is the lowest pressure, thereby setting the second control valve 20C to the stop position 20*c*3.

That is, when the operation detector device 110 detects that the operation amount of the operation member 93 is the minimum in the state where the first control valve 20B is in the non-operation state, the control device 90 sets the second control valve 20C to the stop position 20*c*3 when the control device 90 determines that the operation member 93 is in the neutral position (the second operating position).

Accordingly, when the first control valve 20B is in the non-operation state, the second control valve 20C is set to the operation position (the first position 20*c*1, the second position 20*c*2) by fully stroking the operating member 93.

Next, the operation of the second control valve 20C in the operation state where the first control valve 20B supplies the operation fluid to the first hydraulic actuator 17 (in the state where the first control valve 20B is in either the first position 20*b*1 or the second position 20*b*2) will be described. The state detector device 112 is capable of detecting whether or not the first control valve 20B is in the operation state.

The case where the state detector device 112 detects the non-operation state corresponds to the case where it is detected that the first control valve 20B is not in the operation state. The case where the operation state is not detected corresponds to the case where the first control valve 20B detects the operation state.

That is, the state detector device 112 is configured to detect whether in the non-operation state or the operation state.

In the case where the first control valve 20B is in the operation state, the control device 90 sets the opening aperture of the proportional valve 88*a* to be smaller than the maximum opening aperture when the first operation amount of the operation member 93 detected by the operation detector device 110 is the maximum value. That is, the control device 90 sets the pilot pressure applied to the pressure receiving portion 86*a* to the third pressure PS3 that is lower than the first pressure PS1 and higher than the second pressure PS2.

In other words, when the first control valve 20B is in the operation state and the first operation amount is the maximum value, the control device 90 lowers the current value to be outputted to the proportional valve 88*a* to be lower than the current value in the operation position (the first position 20*c*1). More specifically, the control device 90 sets the maximum value (an upper limit value) of the current value to be outputted to the proportional valve 88*a* to be smaller than the maximum value in the non-operation state.

In this manner, the control device 90 switches the second control valve 20C to the middle position (a first middle position) between the first position 20*c*1 and the stop position 20*c*3. When the second control valve 20C is in the first middle position, the first input port 44*a* and the first output port 82*a* communicate with each other, and the second supply port (the third input port 44*c*) and the discharge port 84 also communicate with each other.

That is, when the second control valve 20C is in the first middle position, the supply fluid tube 72 and the discharge fluid tube 24 communicate with each other, and the return fluid in the first control valve 20B is supplied to the second hydraulic actuator 16 through the supply/discharge fluid tube 83*a*.

In the case where the first control valve 20B is in the operation state, the control device 90 sets the opening aperture of the proportional valve 88*b* to be smaller than the maximum opening aperture when the second operation amount of the operation member 93 detected by the operation detector device 110 is the maximum value. That is, the control device 90 sets the pilot pressure applied to the pressure receiving portion 86*b* to the third pressure PS3 that is lower than the first pressure PS1 and higher than the second pressure PS2.

In other words, when the first control valve 20B is in the operation state and the second operation amount is the maximum value, the control device 90 lowers the current value to be outputted to the proportional valve 88*b* to be lower than the current value in the operation position (the second position 20*c*2). More specifically, the control device 90 sets the maximum value (an upper limit value) of the current value to be outputted to the proportional valve 88*b* to be smaller than the maximum value in the non-operation state.

In this manner, the control device 90 switches the second control valve 20C to the middle position (a second middle position) between the second position 20*c*2 and the stop position 20*c*3. When the second control valve 20C is in the second middle position, the second input port 44*b* and the second output port 82*b* communicate with each other, and the second supply port (the third input port 44*c*) and the discharge port 84 also communicate with each other.

That is, when the second control valve 20C is in the second middle position, the supply fluid tube 72 and the discharge fluid tube 24 communicate with each other, and the return fluid in the first control valve 20B is supplied to the second hydraulic actuator 16 through the supply/discharge fluid tube 83*b*.

The hydraulic system for the working machine, includes: the hydraulic pump P1 to output the operation fluid; the first hydraulic actuator 17; the second hydraulic actuator 16; the first control valve 20B to control the flow rate of the operation fluid to be supplied to the first hydraulic actuator 17; the second control valve 20C to control the flow rate of the operation fluid to be supplied to the second hydraulic actuator 16; the return fluid tube 81 connecting the first control valve 20B and the second control valve 20C and allowing the return fluid to flow in the return fluid tube 81, the return fluid being operation fluid returning from the first hydraulic actuator 17 to the first control valve 20B; the supply fluid tube 72 connecting the first control valve 20B and the second control valve 20C separately from the return fluid tube and being connected to the return fluid tube 81 at the middle portion of the supply fluid tube 72; the discharge fluid tube 24 connected to the second control valve 20C; the operation member 93 to operate the second control valve 20C; and the control device (controller) 90 to control the second control valve 20C in accordance with operation of the operation member 93.

In addition, the second control valve 20C is switched between the operation position (a primary position) (the first position 20*c*1, the second position 20*c*2), the stop position (a secondary position) 20*c*3, and the middle position (a tertiary position). The operation position blocks between the supply fluid tube 72 and the discharge fluid tube 24 and allows the return fluid to be supplied to the second hydraulic actuator 16. The stop position 20*c*3 communicates between the supply fluid tube 72 and the discharge fluid tube 24 and stops supplying the return fluid to the second hydraulic actuator 16. And, the middle position communicates between the supply fluid tube 72 and the discharge fluid tube 24 and allows the return fluid to be supplied to the second hydraulic actuator 16.

The control device (a controller) 90 switches the second control valve 20C to the operation position (the first position 20*c*1, the second position 20*c*2) when the first control valve 20B is under the non-operation state where the operation fluid is not supplied to the first hydraulic actuator 17 and when the operation member 93 is at the first operating position. The control device 90 switches the second control valve 20C to the stop position 20*c*3 when the first control valve 20B is under the non-operation state and when the operation member 93 is at the second operating position. And, the control device 90 switches the second control valve 20C to the middle position when the first control valve 20B is under the operation state where the operation fluid is supplied to the first hydraulic actuator 17 and when the operation member 93 is at the first operating position.

In this manner, when the operating member 93 is operated to the first operating position in the state where the first hydraulic actuator 17 is not operated by the first control valve 20B (in the non-operation state), the second hydraulic actuator 16 can be operated by the return fluid supplied from the first control valve 20B to the second control valve 20C. In addition, when the operation member 93 is in the second operating position, the second hydraulic actuator 16 can be stopped.

On the other hand, when the operation member 93 is operated to the first operating position in the state (the operation state) in which the first hydraulic actuator 17 is operated by the first control valve 20B, the second hydraulic actuator 16 can be operated by the return fluid supplied from the first control valve 20B to the second control valve 20C as in the non-operation state. In addition, when the second control valve 20C stops the operation for some reason, the return fluid flowing from the first control valve 20B to the second control valve 20C is discharged from the supply fluid tube 72 to the discharge fluid tube 24.

That is, when the first hydraulic actuator 17 and the second hydraulic actuator 16 are operated in combination, the return fluid flowing from the first hydraulic actuator 17 to the second control valve 20C is allowed to flow from the supply fluid tube 72 to the discharge fluid tube 24. In this manner, the first hydraulic actuator 17 arranged on the upstream side can be easily operated.

The second control valve 20C includes a first supply port (a first input port 44*a*, a second input port 44*b*) to which the return fluid tube 81 is connected, a second supply port (a third input port 44*c*) to which the supply fluid tube 72 is connected, an output port (a first output port 82*a*, a second output port 82*b*) communicating with the second hydraulic actuator 16, and a discharge port 84 to which the discharge fluid tube 24 is connected.

In addition, the second control valve 20C communicates (connects) the first supply port (the first input port 44*a*, the second input port 44*b*) and the output port (the first output port 82*a*, the second position 20*c*2) at the operation position (the first position 20*c*1, the second position 20*c*2). The second control valve 20C closes the path between the second supply port (the third input port 44*c*) and the discharge port 84 at the operation position. The second control valve 20C closes the path between the first supply port (the first input port 44*a*, the second input port 44*b*) and the output port (first output port 82*a*, second output port 82*b*) at the stop position 20*c*3. The second control valve 20C opens the path between the second supply port (the third input port 44*c*) and the discharge port 84 at the stop position 20*c*3. The second control valve 20C communicates (connects) the first supply port (the first input port 44*a*, the second input port 44*b*) and the output port (the first output port 82*a*, the second output port 82*b*) at the middle position. The second control valve 20C communicates (connects) the second supply port (the third input port 44*c*) and the discharge port 84 at the middle position.

According to that configuration, the communicating (the connecting) between the first supply port (the first input port 44*a*, the second input port 44*b*), the second supply port (the third input port 44*c*), the output port (the first output port 82*a*, the second output port 82*b*), and the discharge port 84 is easily switched in accordance with the switching between the operation position (the first position 20*c*1, the second position 20*c*2), the stop position 20*c*3, and the middle position.

The second control valve 20C is a switching valve having the operation position (the first position 20*c*1, the second position 20*c*2), the stop position 20*c*3, and the middle position, and is configured to be switched between the operation position, the stop position 20*c*3, and the middle position in accordance with the pilot pressure that is the pressure of the pilot fluid supplied to the pressure receiving portions 86*a* and 86*b* of the second control valve 20C. The control device 90 sets the pilot pressure applied to the pressure receiving portions 86*a* and 86*b* to a first pressure corresponding to the operation position (the first position 20*c*1, the second position 20*c*2) when the first control valve 20B is in the non-operation state and the operating member 93 is in the first operating position. The control device 90 sets the pilot pressure applied to the pressure receiving portions 86*a* and 86*b* to a second pressure corresponding to the stop position 20*c*3 when the first control valve 20B is in the non-operation state and the operating member 93 is in the second operating position. When the first control valve 20B is in the operation state and the operation member 93 is in the first operating position, the control device 90 sets the pilot pressure applied to the pressure receiving portions 86*a* and 86*b* to a third pressure corresponding to the middle position.

In this manner, since the pilot pressure (the first pressure, the second pressure, the third pressure) can be easily set in accordance with the position (the first operating position, the second operating position) of the operation member 93, the second control valve 20 can be switched smoothly in accordance with the position of the operation member 93.

The hydraulic system for the working machine includes the proportional valves 88*a* and 88*b* configured to set the pilot pressure applied to the pressure receiving portions 86*a* and 86*b* of the second control valve 20C, the operation detector device 110 configured to detect either the first operating position and the second operating position of the operation member 93, and the state detector device 112 configured to detect either the non-operation state or the operation state of the first control valve 20B. The control device 90 sets the opening apertures of the proportional valves 88*a* and 88*b* based on either one of the first operating position and the second operating position detected by the operation detector device 110 and on one of the non-operation state and the operation state detected by the state detector device 112, and thereby setting the first pressure, the second pressure, and the third pressure.

According to that configuration, the opening apertures of the proportional valves 88*a* and 88*b* can be easily set in accordance with the position (the first operating position, the second operating position) detected by the operation detector device 110 and with the state (the non-operation state, the operation state) detected by the state detector device 112.

When the first pressure is referred to as PS1, the second pressure is referred to as PS2, and the third pressure is referred to as PS3, the equation, PS1>PS3>PS2, is satisfied.

According to that configuration, the supply fluid tube 72 and the discharge fluid tube 24 can be easily connected while the second hydraulic actuator 16 is operated by the second control valve 20C by lowering the second pressure applied to the pressure receiving portion of the second control valve 20C when the first control valve 20B is in the operation state in comparison with the first pressure applied to the pressure receiving portion of the second control valve 20C when the first control valve 20B is the non-operation state.

In the hydraulic system for the working machine, the first hydraulic actuator 17 is constituted of a hydraulic cylinder configured to be stretched and shortened. The first control valve 20B is a switching valve configured to stretch and shorten the hydraulic cylinder. The control device 90 switches the second control valve 20C to the middle position in the case where the first control valve 20B supplies the operation fluid to the hydraulic cylinder to shorten the hydraulic cylinder in the operating state.

According to that configuration, even in the case where the return fluid to the second control valve 20C cannot be supplied, the first hydraulic actuator 17 is capable of being shortened.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims. The first control valve and the second control valve are not limited to the embodiment mentioned above, and may be any types of control valves provided in the working machine.

In the embodiment described above, the operation fluid is discharged to the operation fluid tank, but may be discharged to other places. That is, the fluid tube for discharging the operation fluid may be connected to a portion other than the operation fluid tank. For example, the fluid tube for discharging the operation fluid may be connected to a suction portion (portion for sucking the operation fluid) of the hydraulic pump, or may be connected to other portions.

In the embodiment described above, the control valve is constituted of a three-position switching valve, but the number of the switching positions is not limited. The control valve may be constituted of a two-position switching valve, a four-position switching valve, or another switching valve.

In the embodiment described above, the hydraulic pump is constituted of a constant displacement pump (a fixed displacement pump). However, the hydraulic pump may be constituted of, for example, a variable displacement pump whose output rate is changed by changing the swash plate, or constituted of another type of hydraulic pump.

In addition, the first hydraulic actuator, the second hydraulic actuator, the third hydraulic actuator, the first control valve, the second control valve, and the third control valve are not limited to those of the above-described embodiment, and may be other types of components configured to be provided in the working machine 1.

Second Embodiment

Hereinafter, a hydraulic system for a working machine according to a second embodiment of the present invention and the working machine including the hydraulic system will be described with reference to the drawings as appropriate.

The hydraulic system according to the present embodiment is provided in the working machine 1 described in the first embodiment. The description of the configuration of the working machine 1 is omitted.

Figure 3:
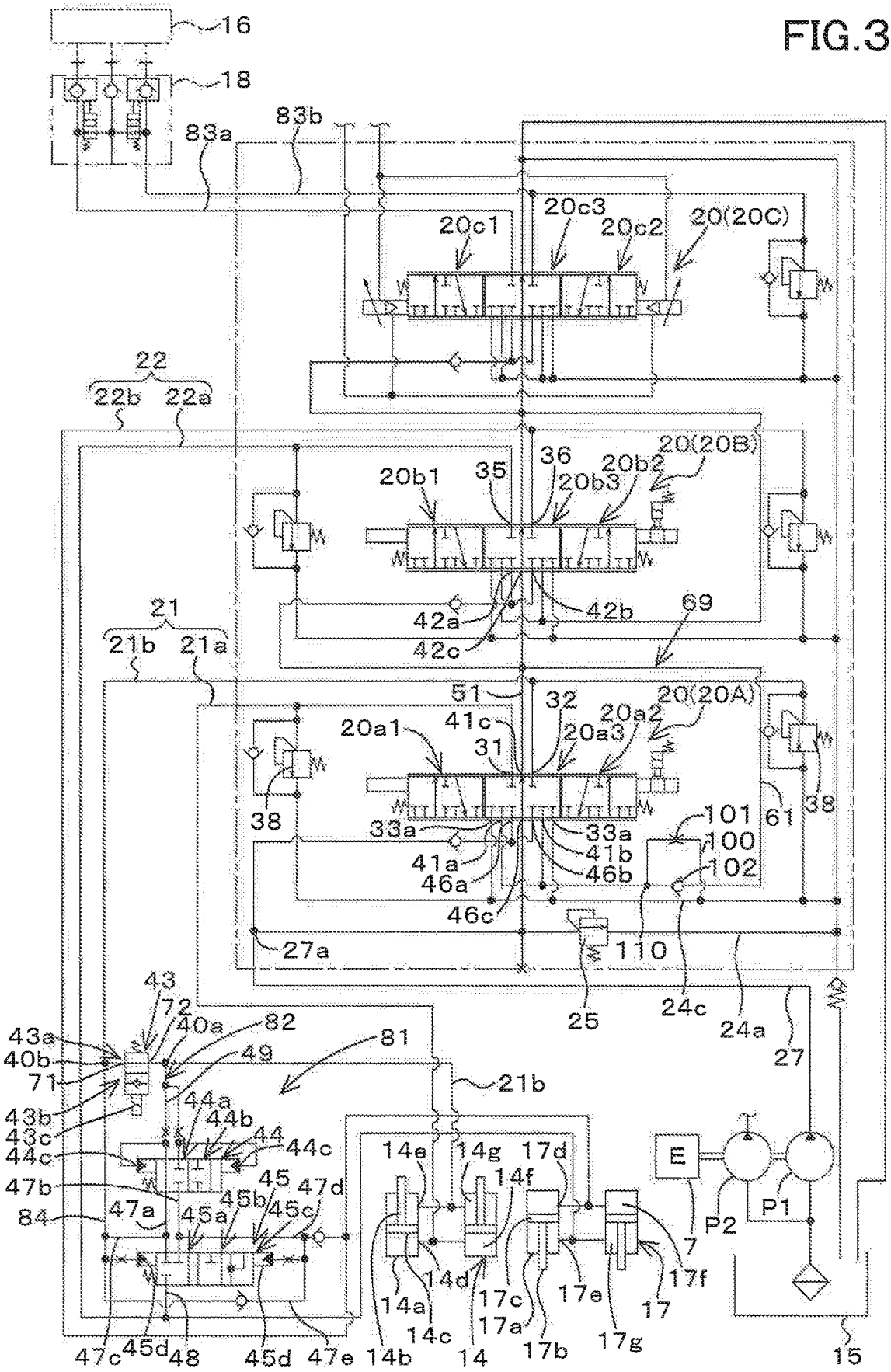
FIG. 3 is a view illustrating a hydraulic system (a hydraulic circuit) for a working machine according to a second embodiment of the present invention.

The working system hydraulic system according to the present embodiment is a system for operating the boom 10, the bucket 11, the auxiliary attachment, and the like. As shown in FIG. 3, the working system hydraulic system includes a plurality of control valves 20 and a working system hydraulic pump (a first hydraulic pump) P1. In addition, the working system hydraulic system is provided with a second hydraulic pump P2 other than the first hydraulic pump P1.

The first hydraulic pump P1 is a pump configured to be operated by the power of the prime mover 7. The first hydraulic pump P1 is constituted of a constant displacement gear pump (a fixed displacement gear pump). The first hydraulic pump P1 is configured to output the operation fluid stored in the tank (the operation fluid tank) 15.

The second hydraulic pump P2 is a pump configured to be operated by the power of the prime mover 7. The second hydraulic pump P2 is constituted of a constant displacement gear pump (a fixed displacement gear pump). The second hydraulic pump P2 is configured to output the operation fluid stored in the tank (the operation fluid tank) 15.

The second hydraulic pump P2 outputs the operation fluid for signal and the operation fluid for control in the hydraulic system. The operation fluid for signal and the operation fluid for control are referred to as a pilot fluid.

The plurality of control valves 20 are valves configured to control various types of hydraulic actuators provided in the working machine 1. The hydraulic actuator is a device configured to be operated by the operation fluid, such as a hydraulic cylinder and a hydraulic motor.

In this embodiment, the plurality of control valves 20 are a boom control valve 20A, a bucket control valve 20B, and an auxiliary control valve 20C.

The boom control valve 20A is a valve for controlling a hydraulic actuator (a boom cylinder) 14 configured to operate the boom 10. The boom control valve 20A is a three-position switching valve having a direct acting spool.

The boom control valve 20A is switched between to a neutral position 20*a*3, a first position 20*al* other than the neutral position 20*a*3, and a second position 20*a*2 other than the neutral position 20*a*3 and the first position 20*al*. The switching between the neutral position 20*a*3, the first position 20*al*, and the second position 20*a*2 in the boom control valve 20A is performed by moving the spool through the operation of the operation member.

The boom control valve 20A is switched by moving the spool directly through the manual operation of the operation member. However, the spool may be moved through the hydraulic operation (the hydraulic operation by a pilot valve, the hydraulic operation by a proportional valve). In particular, the spool may be moved through the electric operation (the electric operation by magnetizing a solenoid). Further, the spool may be moved in other methods.

The boom control valve 20A and the first hydraulic pump P1 are connected by an output fluid tube 27. A discharge fluid tube 24*a* connected to the operation fluid tank 15 is connected to a section between the boom control valve 20A and the first hydraulic pump P1 in the output fluid tube 27.

A relief valve (a main relief valve) 25 is arranged in the middle portion of the discharge fluid tube 24*a*. The operation fluid outputted from the first hydraulic pump P1 flows through the output fluid tube 27, and is supplied to the boom control valve 20A.

In addition, the boom control valve 20A and the boom cylinder 14 are connected by a fluid tube 21.

In particular, the boom cylinder 14 includes a cylinder body 14*a*, a rod 14*b* arranged movably in the cylinder body 14*a*, and a piston 14*c* arranged on the rod 14*b*. A first port 14*d* through which the operation fluid is supplied and discharged is arranged at the base end portion of the cylinder body 14*a* (on the side opposite to the rod 14*b* side). A second port 14*e* through which the operation fluid is supplied and discharged is arranged at the tip end (on the rod 14*b* side) of the cylinder body 14*a*.

The fluid tube 21 includes a first connection fluid tube 21*a* that connects the first port 31 of the boom control valve 20A and the first port 14*d* of the boom cylinder 14, and a second connection fluid tube 21*b* that connects the second port 32 of the boom control valve 20A and the second port 14*e* of the boom cylinder 14.

Thus, when the boom control valve 20A is set to the first position 20*al*, the operation fluid can be supplied from the first connection fluid tube 21*a* to the first port 14*d* of the boom cylinder 14. In addition, the operation fluid can be discharged from the second port 14*e* of the boom cylinder 14 to the second connection fluid tube 21*b*. In this manner, the boom cylinder 14 is stretched, and the boom 10 is lifted.

When the boom control valve 20A is set to the second position 20*a*2, the operation fluid can be supplied from the second connection fluid tube 21*b* to the second port 14*e* of the boom cylinder 14. In addition, the operation fluid can be discharged from the first port 14*d* of the boom cylinder 14 to the first connection fluid tube 21*a*. In this manner, the boom cylinder 14 is shortened, and the boom 10 is lowered.

The bucket control valve 20B is a valve for controlling a hydraulic cylinder (a bucket cylinder) 17 configured to control the bucket 11. The bucket control valve 20B is constituted of a pilot-type three-position switching valve having a direct acting spool.

The bucket control valve 20B is switched between a neutral position 20*b*3, a first position 20*b*1 other than the neutral position 20*b*3, and a second position 20*b*2 other than the neutral position 20*b*3 and the first position 20*b*1. In the bucket control valve 20B, the switching between the neutral position 20*b*3, the first position 20*b*1, and the second position 20*b*2 is performed by moving the spool through the operation of the operation member.

In addition, the bucket control valve 20B is switched by moving the spool directly through the manual operation of the operation member. However, the spool may be moved through the hydraulic operation (the hydraulic operation by the pilot valve, the hydraulic operation by the proportional valve). In addition, the spool may be moved through the electric operation (the electric operation by magnetizing a solenoid). In addition, the spool may be moved in other methods.

The bucket control valve 20B and bucket cylinder 17 are connected by a fluid tube 22. In particular, the bucket cylinder 17 includes a cylinder body 17*a*, a rod 17*b* movably arranged on the cylinder body 17*a*, and a piston 17*c* arranged on the rod 17*b*.

A first port 17*d* through which the operation fluid is supplied and discharged is arranged at the base end portion of the cylinder body 17*a* (on the side opposite to the rod 17*b* side). A second port 17*e* through which the operation fluid is supplied and discharged is arranged at the tip portion (on the rod 17*b* side) of the cylinder body 17*a*.

The fluid tube 22 includes a first connection fluid tube 22*a* that connects the first port 35 of the bucket control valve 20B and the second port 17*e* of the bucket cylinder 17, and includes a second connection fluid tube 22*b* that connects a second port 36 of the bucket control valve 20B and the first port 17*d* of the bucket cylinder 17.

Thus, when the bucket control valve 20B is set to the first position 20*b*1, the operation fluid can be supplied from the first connection fluid tube 22*a* to the second port 17*e* of the bucket cylinder 17. In addition, the operation fluid can be discharged from the first port 17*d* of the bucket cylinder 17 to the second connection fluid tube 22*b*.

In this manner, the bucket cylinder 17 is shortened, and the bucket 11 performs the shoveling operation.

When the bucket control valve 20B is set to the second position 20*a*2, the operation fluid can be supplied from the second connection fluid tube 22*b* to the first port 17*d* of the bucket cylinder 17. In addition, the operation fluid can be discharged from the second port 17*e* of the bucket cylinder 17 to the first connection fluid tube 22*a*.

In this manner, the bucket cylinder 17 is stretched, and performs the dumping operation.

Meanwhile, a drain fluid tube 24*c* is connected to the first connection fluid tube 21*a* and the second connection fluid tube 21*b*. In addition, the discharge fluid tube 24*c* is connected to the first discharge port 33*a* and the second discharge port 33*b* of the first control valve 20A, and can discharge the operation fluid to the discharge portion.

The discharge portion is the operation fluid tank and the suction portion of the hydraulic pump (a portion for sucking the operation fluid). The discharge portion is a portion from which the operation fluid is discharged. In addition, the discharge portion may be other than the operation fluid tank and the suction portion of the hydraulic pump, and is not limited thereto.

In addition, a relief valve 38 is arranged in the drain fluid tube 24*c*. The set pressure of the relief valve 38 is set to be higher than the set pressure of the main relief valve 25, for example.

It should be noted that the hydraulic actuator arranged on the upstream side may be easily operated by setting the set pressure of the relief valve 38 to be lower than the set pressure of the main relief valve 25.

The auxiliary control valve 20C is a valve for controlling the hydraulic actuator (the hydraulic cylinder, the hydraulic motor, or the like) 16 attached to the auxiliary attachment. The auxiliary control valve 20C is constituted of a three-position switching valve having a pilot-type direct acting spool. The auxiliary control valve 20C is switched between a neutral position 20*c*3, a first position 20*c*1 other than the neutral position 20*c*3, and a second position 20*c*2 other than the neutral position 20*c*3 and the first position 20*c*1.

In the auxiliary control valve 20C, the switching between the neutral position 20*c*3, the first position 20*c*1, and the second position 20*c*2 is performed by moving the spool through the pilot fluid pressure. A connecting member 18 is connected to the auxiliary control valve 20C via the supply/discharge fluid tubes 83*a* and 83*b*.

The connecting member 18 is connected to a fluid tube connected to the hydraulic actuator (the auxiliary hydraulic actuator) 16 for the auxiliary attachment.

Thus, when the auxiliary control valve 20C is set to the first position 20*c*1, the operation fluid can be supplied from the supply/discharge fluid tube 83*a* to the hydraulic actuator 16 of the auxiliary attachment. When the auxiliary control valve 20C is set to the second position 20*c*2, the operation fluid can be supplied from the supply/discharge fluid tube 83*b* to the hydraulic actuator 16 of the auxiliary attachment.

In this manner, when the operation fluid is supplied from the supply/discharge fluid tube 83*a* or the supply/discharge fluid tube 83*b* to the hydraulic actuator 16, the hydraulic actuator 16 (the auxiliary attachment) can be operated.

Now, a series circuit (a series fluid tube) is employed in the hydraulic system. In the series circuit, the operation fluid returned from the hydraulic actuator to the control valve arranged on the upstream side can be supplied to the control valve arranged on the downstream side. For example, focusing on the boom control valve 20A and the bucket control valve 20B, the boom control valve 20A is the control valve arranged on the upstream side, and the bucket control valve 20B is the control valve arranged on the downstream side.

Hereinafter, the control valve arranged on the upstream side is referred to as a "first control valve", and the control valve arranged on the downstream side is referred to as a "second control valve". In addition, the hydraulic actuator corresponding to the first control valve is referred to as a "first hydraulic actuator". The hydraulic actuator corresponding to the second control valve is referred to as a "second hydraulic actuator". The operation fluid returning from the first hydraulic actuator to the first control valve is referred to as the return fluid.

In this embodiment, the boom control valve 20A is the "first control valve", and the bucket control valve 20B is the "second control valve". In addition, the boom cylinder 14 is the "first hydraulic actuator", and the bucket cylinder 17 is the "second hydraulic actuator".

The working system hydraulic system includes the communication fluid tube 69. The communication fluid tube 69 is a fluid tube allowing the return fluid discharged from the first hydraulic actuator 14 to be supplied to the second control valve 20B through the first control valve 20A. The communication fluid tube 69 includes a first return fluid tube and a second return fluid tube 61.

The first return fluid tube is a fluid tube through which the return fluid discharged from the first hydraulic actuator 14 flows to the first control valve 20A. In this embodiment, the first return fluid tube is the second connection fluid tube 21*b*. Hereinafter, the second connection fluid tube 21*b* is referred to as a "first return fluid tube".

The first return fluid tube 21*b* is a fluid tube allowing the return fluid discharged from the first hydraulic actuator (the boom cylinder) 14 to flow to the first control valve (the boom control valve) 20A when the first hydraulic actuator (the boom cylinder) 14 is stretched with the first control valve (the boom control valve) 20A in the first position 20*al*, that is, when the boom is lifted.

The second return fluid tube 61 is a fluid tube through which the return fluid having flowed through the first control valve 20A flows to the second control valve 20B. The second return fluid tube 61 connects the first output port 41*a* of the first control valve 20A and the first input port 42*a* of the second control valve 20B, and connects the second output port 41*b* of the first control valve 20A and the second input port 42*b* of the second control valve 20B. A middle portion of the second return fluid tube 61 is connected to the center fluid tube 51.

The first control valve 20A is connected to the output portion of the first hydraulic pump P1 by an output fluid tube 27. The output fluid tube 27 is branched off at the connecting portion 27*a*. The branched fluid tube of the output fluid tube 27 is connected to the first input port 46*a* and the second input port 46*b* of the first control valve 20A. In addition, the output fluid tube 27 is connected to the third input port 46*c* of the first control valve 20A.

Thus, the operation fluid outputted from the first hydraulic pump P1 is supplied into the first control valve 20A through the output fluid tube 27, the first input port 46*a*, the second input port 46*b*, and the third input port 46*c*.

The first control valve 20A and the second control valve 20B are connected by the center fluid tube 51. The center fluid tube 51 couples the third output port 41*c* of the first control valve 20A and the third input port 42*c* of the second control valve 20B.

The communication fluid tube 69 is provided with a bypass fluid tube 82 that branches from the communication fluid tube 69. The bypass fluid tube 82 is a fluid tube branched from a middle portion of the first return fluid tube 21*b*, and is a fluid tube to which the leveling control valve 81 is connected in the middle portion.

At least two or more branched portions 40*a* and 40*b* are arranged on the middle portion of the first return fluid tube 21*b* of the communication fluid tube 69. One end of the bypass fluid tube 82 is connected to the branched portion 40*a*. The other end of the bypass fluid tube 82 is connected to the branched portion 40*b*.

In the first return fluid tube 21*b*, an operation valve 43 is arranged in a section between the branched portion 40*a* and the branched portion 40*b*. In this embodiment, the operation valve 43 is provided, but the operation valve 43 is not a necessarily-required component.

Figure 5:
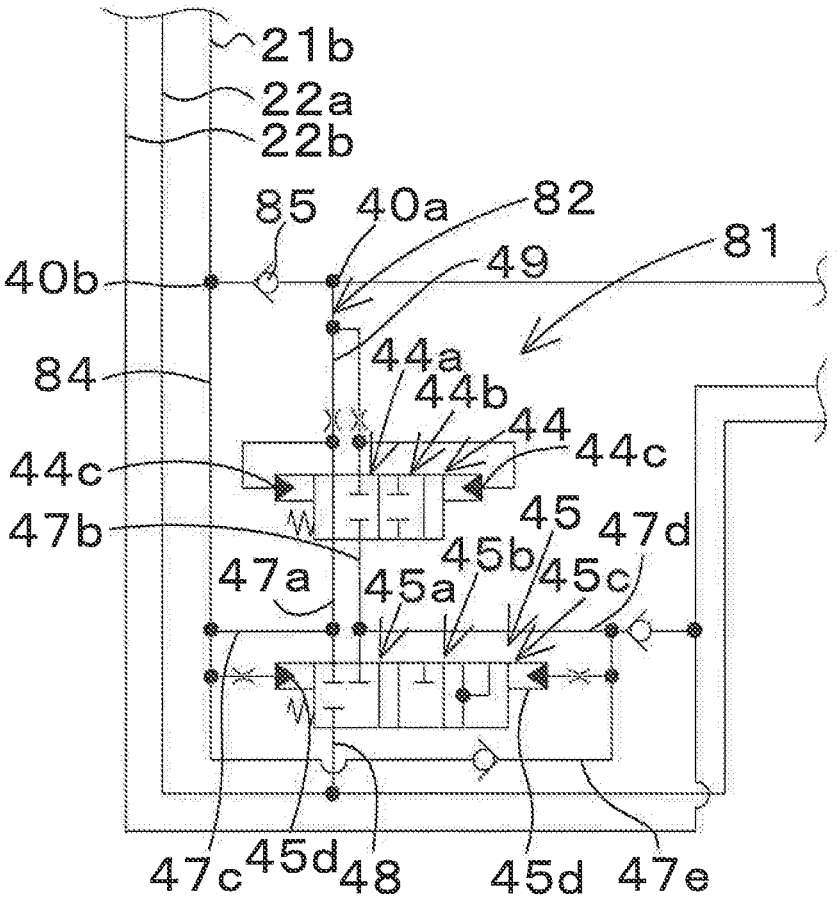
FIG. 5 is a view illustrating an example of the hydraulic system for the working machine having no operation valve according to the second embodiment.

As shown in FIG. 5, when the operation valve 43 is not provided, the second check valve 85 is arranged on a side closer to the first control valve 20A with respect to the branched portion 40*a* in the first return fluid tube 21*b*. For example, the second check valve 85 is arranged between the branched portion 40*a* and the branched portion 40*b* at a position corresponding to the operation valve 43, that is, in the first return fluid tube 21*b*.

The second check valve 85 allows the operation fluid to flow from the first control valve 20A to the first hydraulic actuator 14, and prevents the operation fluid from flowing from the first hydraulic actuator 14 to the first control valve 20A.

The leveling control valve 81 is a valve for performing a leveling operation of the second hydraulic actuator (the bucket cylinder) 17. The operation valve 43 is a valve configured to be switched between the first position 43*a* and the second position 43*b*.

When the operation valve 43 is in the first position 43*a*, the operation valve 43 communicates between the ports 71 and 72, and supplies the return fluid having returned from the first hydraulic actuator (the boom cylinder) 14 to flow to the first control valve 20A side. That is, when the operating valve 43 is in the first position 43*a*, the operating valve 43 is in a state of stopping supplying the return fluid to the bypass fluid tube 82 and the leveling control valve 81.

When the operating valve 43 is in the second position 43*b*, the communication between the ports 71 and 72 is blocked. That is, when the operating valve 43 is in the second position 43*b*, the operating valve 43 is in a state of supplying the return fluid having returned from the first hydraulic actuator (the boom cylinder) 14 to the bypass fluid tube 82 and the leveling control valve 81.

In other words, the operation valve 43 is a valve configured to stop supplying the return fluid to the leveling control valve 81 to stop the leveling operation and to supply the return fluid to the leveling control valve 81 to operate the leveling operation.

In addition, the operation valve 43 is an electromagnetic switching valve that is switched to the first position 43*a* by a spring and switched to the second position 43*b* through magnetization of the solenoid 43*c*.

The operation valve 43 may be a switching valve configured to be switched between the first position 43*a* and the second position 43*b* through the manual operation or the like.

In addition, the operation valve 43 may be other than the switching valve, and may be a proportional valve or another type of valve.

In addition, the switching of the operation valve 43 (the switching between the first position 43*a* and the second position 43*b*) can be performed by a switch or the like arranged in the vicinity of the operator seat 8 or the like.

The leveling control valve 81 has a first switching valve 44 and a second switching valve 45. The first switching valve 44 is constituted of a pilot-switching two-position switching valve configured to be switched between the first position 44*a* and the second position 44*b*. The first switching valve 44 is connected to the bypass fluid tube 82. The pressure of the operation fluid in the bypass fluid tube 82 (the pressure of the return fluid) is applied to the pressure receiving portion 44*c* of the first switching valve 44.

The second switching valve 45 is constituted of a pilot-switching three-position switching valve configured to be switched between a first position 45*a*, a second position 45*b*, and a third position 45*c*. The first switching valve 44 and the second switching valve 45 are coupled each other by fluid tubes 47*a* and 47*b*.

A fluid tube 47*c* is connected to the fluid tube 47*a*, and a fluid tube 47*d* is connected to the fluid tube 47*b*. The fluid tube 47*c* and the fluid tube 47*d* are coupled each other by a fluid tube 47*e*, and the pressure receiving portion 45*d* of the second switching valve 45 is connected to the fluid tube 47*e*.

In addition, the second switching valve 45 and the first connection fluid tube 22*a* are coupled by a fluid tube 48. Thus, when the leveling control valve 81 operates, the pressure of the operation fluid in the fluid tubes 47*a* and 47*b* is applied to the pressure receiving portion 45*d* of the second switching valve 45.

The bypass fluid tube 82 includes a fluid tube 49 coupling the branched portion 40*a* and the first switching valve 44, a fluid tube 47*a* couples the first switching valve 44 and the second switching valve 45, the fluid tube 47*c* connected to the fluid tube 47*a*, and the fluid tube 84 coupling the fluid tube 47*c* and the branched portion 40*b*.

Thus, in the case of the first position 43*a* (when the leveling operation is off), the first hydraulic actuator (the boom cylinder) 14 can be stretched and shortened by the switching of the first control valve 20A. In addition, the second hydraulic actuator (the bucket cylinder) 17 can be stretched and shortened by the switching of the second control valve 20B.

In the case of the second position 43*b* (when the leveling operation is on), when the first hydraulic actuator (the boom cylinder) 14 is stretched, that is, when the boom 10 is lifted, the return fluid from the first hydraulic actuator (the boom cylinder) 14 (referred to as the boom return fluid) is shut off by the operation valve 43.

The boom return fluid enters the fluid tube 49 from the branched portion 40*a*, is applied to the pressure receiving portion 44*c* of the first switching valve 44, and is applied to the pressure receiving portion 45*d* of the second switching valve 45. Then, the boom return fluid is applied to the first connection fluid tube 22*a* through the fluid tube 48 by the switching of the first switching valve 44 and the second switching valve 45.

As the result, the second hydraulic actuator (the bucket cylinder) 17 dumps, that is, performs the leveling operation with use of the boom return fluid.

In addition, the return fluid having flowed through the fluid tube 47*a* of the first switching valve 44 flows through the fluid tube 47*c* and the fluid tube 84, flows to the first return fluid tube 21*b*, and then flows toward the first control valve 20A.

The working system hydraulic system includes a return discharge fluid tube 100. The return discharge fluid tube 100 is a fluid tube configured to discharge, to the discharge portion, at least a part of the return fluid flowing through the communication fluid tube 69. The return discharge fluid tube 100 is a fluid tube connected, in the communication fluid tube 69, to a side closer to the second control valve 20B with respect to a portion where the leveling control valve 81 is arranged.

In other words, paying attention to the communication fluid tube 69, the leveling control valve 81 is connected to the upstream side (the first hydraulic actuator 14 side)

through which the return fluid flows. In addition, the return drain fluid tube 100 is connected to the downstream side of the leveling control valve 81 (the second control valve 20B side).

In this embodiment, the return discharge fluid tube 100 is connected to the second return fluid tube 61 of the communication fluid tube 69. In particular, one end of the return discharge fluid tube 100 is connected to the second return fluid tube 61, and the other end is connected to the discharge fluid tube 24*c*.

A throttle 101 is connected to the return discharge fluid tube 100. The throttle portion 101 is configured, for example, by making a part of the return discharge fluid tube 100 thinner than the other parts.

In other words, the throttle portion 101 is configured by making the cross-sectional area of the portion where the operation fluid flows smaller than the other portions in the return discharge fluid tube 100. In addition, the structure of the return discharge fluid tube 100 is not limited to the example mentioned above.

A first check valve 102 is connected to the second return fluid tube 61. The first check valve 102 is a valve configured to allow the return fluid to flow from the first control valve 20A to the second control valve 20B, and to prevent the operation fluid from flowing from the second control valve 20B to the return discharge fluid tube 100.

In particular, the first check valve 102 is arranged, in the second return fluid tube 61, on a section between the first connecting portion 110 and the second connecting portion (the first input port 42*a* and the second input port 42*b*), the first connecting portion 110 coupling the second return fluid tube 61 and the return discharge fluid tube 100, the second connecting portion coupling the second return fluid tube 61 and the second control valve 20B.

Thus, when the first control valve 20A is set to the second position 20*a*2 under the state where the operation valve 43 is in the first position 43*a* (the state where the leveling operation is stopped), the first return fluid tube 21*b* and the second return fluid tube 61 communicate with each other. Thus, the return fluid from the first hydraulic actuator 14 can flow to the second return fluid tube 61 through the first return fluid tube 21*b*.

As described above, since the return discharge fluid tube 100 is connected to the second return fluid tube 61, a part of the return fluid can be discharged to the return discharge fluid tube 100.

On the other hand, when the first control valve 20A is set to the second position 20*a*2 under the state where the operation valve 43 is in the second position 43*b* (the state where the leveling operation is activated), the return fluid from the first hydraulic actuator 14 can be supplied to the leveling control valve 81 through the bypass fluid tube 82.

That is, the return fluid from the first hydraulic actuator 14 flows to the leveling control valve 81 through at least the bypass fluid tube 82 under the state where the leveling operation is activated, and thus the operation of the leveling control valve 81 can be stabilized.

In addition, the second return fluid tube 61 is provided with a first check valve 102. In this manner, the operation fluid in the second return fluid tube 61 is prevented from reversely flowing to the first control valve 20A in accordance with the relation between the pressure of the operation fluid in the center fluid tube 51 and the pressure of the operation fluid flowing from the second return fluid tube 61 toward the second control valve 20B.

FIG. 4A to FIG. 4D show modified examples of the working system hydraulic system. In FIG. 4A to FIG. 4D, the leveling control valve 81 is omitted. However, the leveling control valve 81 is connected to the branched fluid tube 46 as in FIG. 3, and further the leveling control valve 81 and the like are provided as in FIG. 3. Thus, the explanations thereof will be omitted.

Figure 4A:
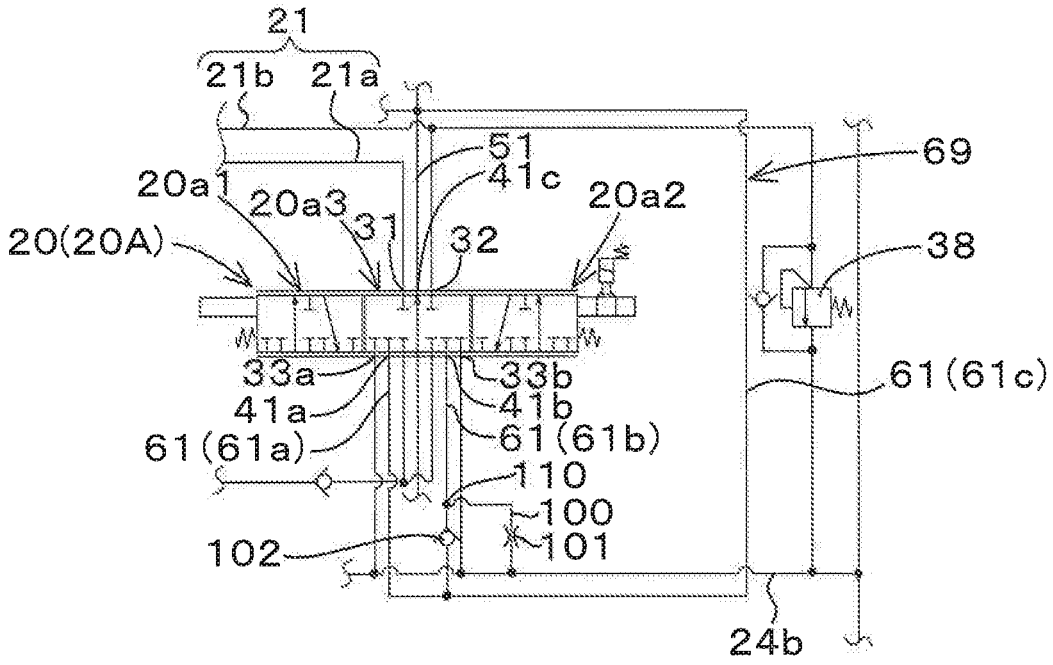
FIG. 4A is a view illustrating a first modified example of the hydraulic system for the working machine according to the second embodiment.

In the modified example shown in FIG. 4A, the second return fluid tube 61 includes a fluid tube 61*a* connected to the first output port 41*a*, a fluid tube 61*b* connected to the second output port 41*b*, and a fluid tube 61*c* connected to the fluid tube 61*a* and the fluid tube 61*b* and connected to the second control valve 20B. In addition, one end of the return discharge fluid tube 100 is connected to the fluid tube 61*b*, and the other end of the return discharge fluid tube 100 is connected to the discharge fluid tube 24*c*. In addition, the fluid tube 61*b* is provided with a first check valve 102.

Figure 4B:
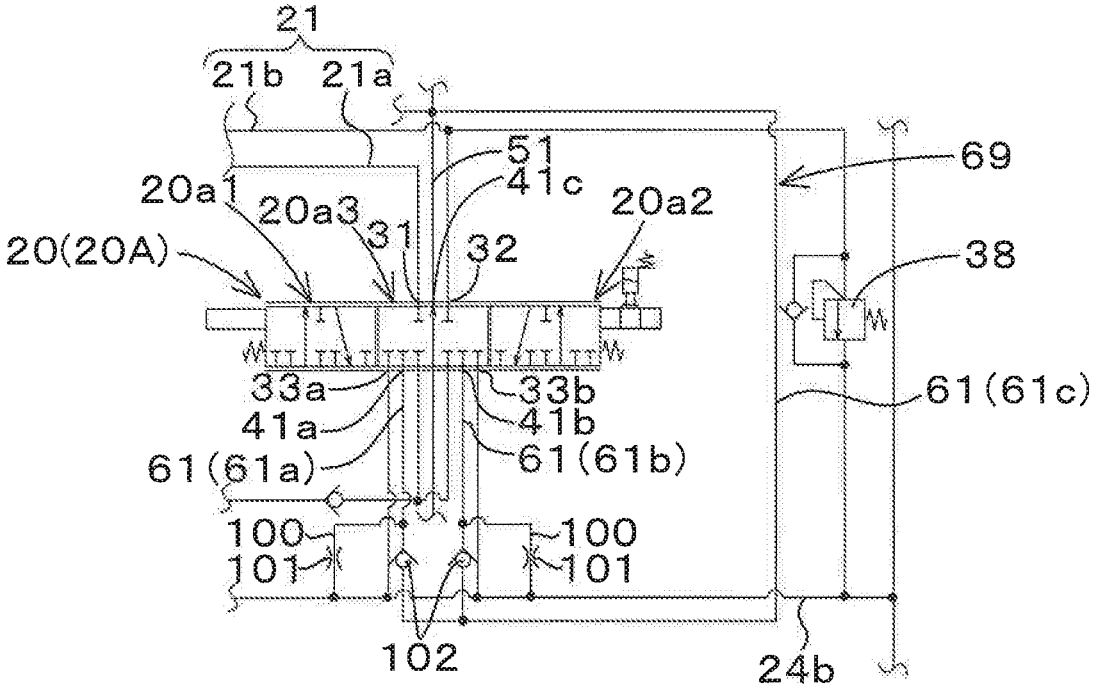
FIG. 4B is a view illustrating a second modified example of the hydraulic system for the working machine according to the second embodiment.

In the modified example shown in FIG. 4B, the working system hydraulic system has at least two (a plurality of) return discharge fluid tubes 100. One of the return discharge fluid tubes 100 is connected to the fluid tube 61*a* and the drain fluid tube 24*c*. The other one of the return discharge fluid tubes 100 is connected to the fluid tube 61*b* and the drain fluid tube 24*c*. The first check valve 102 is arranged in one of the return discharge fluid tubes 100 and the other one of the return discharge fluid tubes 100.

Figure 4C:
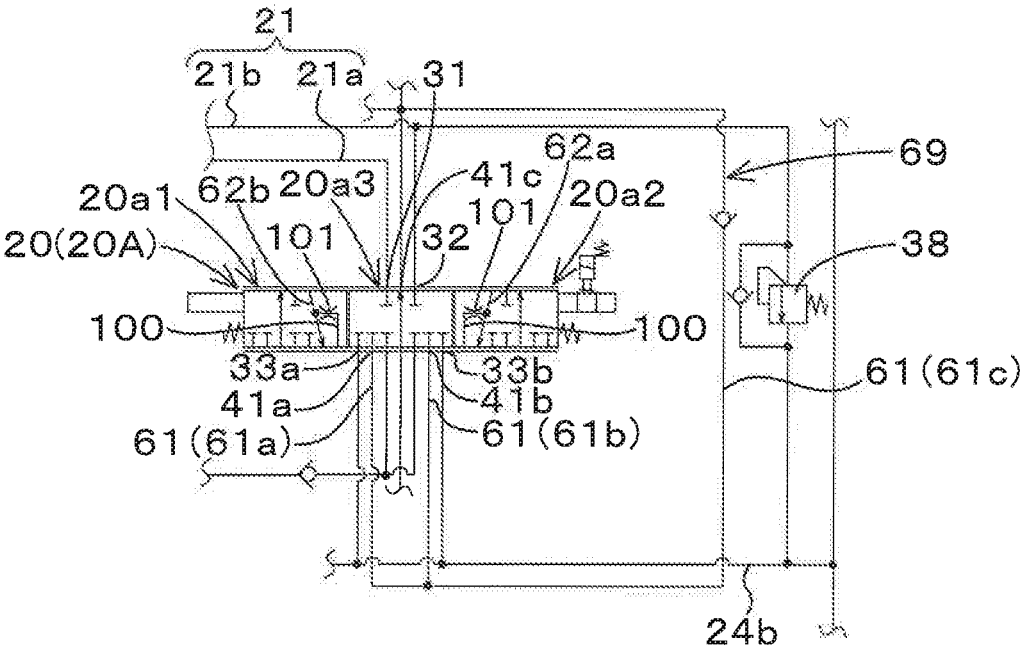
FIG. 4C is a view illustrating a third modified example of the hydraulic system for the working machine according to the second embodiment.

In the modified example shown in FIG. 4C, the return discharge fluid tube 100 is arranged inside the first control valve 20A. In particular, the first control valve 20A includes a fluid tube (an internal fluid tube) 62*a* that communicates between the first port 31 and the first output port 41*a* when the first control valve 20A is in the second position 20*a*2. One end of the return discharge fluid tube 100 is connected to the internal fluid tube 62*a*, and the other end is connected to the first discharge port 33*a*.

The first control valve 20A includes a fluid tube (an internal fluid tube) 62*b* that communicates between the second port 32 and the second output port 41*b* when the first control valve 20A is in the first position 20*a*1. The return discharge fluid tube 100 may be arranged in the internal fluid tube 62*b*.

Figure 4D:
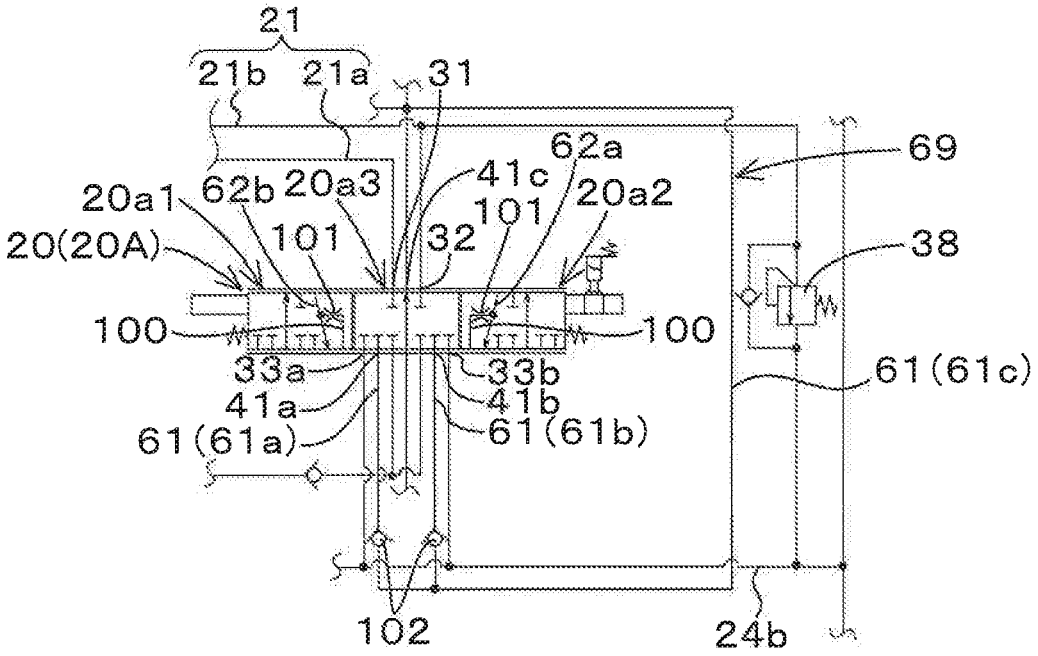
FIG. 4D is a view illustrating a fourth modified example of the hydraulic system for the working machine according to the second embodiment.

FIG. 4D is a modified example of the configuration shown in FIG. 4C, and the first check valve 102 is arranged in the fluid tube 61*a* and the fluid tube 61*b*. In any one of the modified examples shown in FIG. 4A to FIG. 4D, at least a part of the return fluid from the first hydraulic actuator 14 can be discharged from the return discharge fluid tube 100 to the discharge fluid tube 24*c*. In addition, the remaining return fluid can be supplied to the second control valve 20B.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

A first control valve and a second control valve are not limited to those of the embodiments described above, and any types of control valves arranged on the working machine may be employed as the first control valve and the second control valve. In the embodiment described above, the hydraulic pump is a fixed displacement pump. However, for example, the hydraulic pump may be a variable displacement pump configured to change the output flow late by changing an angle of the swash plate, or may be another type of hydraulic pump.

What is claimed is:

1. A hydraulic system for a working machine, comprising:

a hydraulic pump;

a first hydraulic actuator;

a second hydraulic actuator;

a first control valve to control a flow rate of operation fluid to be supplied to the first hydraulic actuator;

a second control valve to control a flow rate of operation fluid to be supplied to the second hydraulic actuator;

a return fluid tube connecting the first control valve and the second control valve and allowing a return fluid to flow in the return fluid tube, the return fluid being operation fluid returning from the first hydraulic actuator to the first control valve;

a supply fluid tube connecting the first control valve and the second control valve separately from the return fluid tube and being connected to the return fluid tube at a middle portion of the supply fluid tube;

a discharge fluid tube connected to the second control valve;

an operation member to operate the second control valve; and a controller to control the second control valve in accordance with operation of the operation member, wherein the second control valve is switched between a primary position, a secondary position, and a tertiary position, the primary position blocking between the supply fluid tube and the discharge fluid tube and allowing the return fluid to be supplied to the second hydraulic actuator, the secondary position communicating between the supply fluid tube and the discharge fluid tube and stopping supplying the return fluid to the second hydraulic actuator, and the tertiary position communicating between the supply fluid tube and the discharge fluid tube and allowing the return fluid to be supplied to the second hydraulic actuator, and wherein the controller switches the second control valve to the primary position when the first control valve is under a non-operation state where operation fluid is not supplied to the first hydraulic actuator and when the operation member is at a first operating position, switches the second control valve to the secondary position when the first control valve is under the non-operation state and when the operation member is at a second operating position, and switches the second control valve to the tertiary position when the first control valve is under an operation state where operation fluid is supplied to the first hydraulic actuator and when the operation member is at the first operating position.

2. The hydraulic system according to claim 1, wherein the second control valve includes:

a first supply port to which the return fluid tube is connected;

a second supply port to which the supply fluid tube is connected;

an output port connected to the second hydraulic actuator; and a discharge port to which the discharge fluid tube is connected, and wherein the second control valve, at the primary position, communicates between the first supply port and the output port and closes a path between the second supply port and the discharge port, at the secondary position, closes a path between the first supply port and the output port and opens the path between the second supply port and the discharge port, and at the tertiary position, communicates between the first supply port and the output port and communicates between the second supply port and the discharge port.

3. The hydraulic system according to claim 2, wherein the second control valve is a switching valve to be switched between the primary position, the secondary position, and the tertiary position by a pilot pressure that is a pressure of pilot fluid applied to a pressure-receiving portion of the second control valve, and wherein the controller sets the pilot pressure applied to the pressure-receiving portion to a first pressure corresponding to the primary position when the first control valve is under the non-operation state and when the operation member is at the first operating position, sets the pilot pressure to a second pressure corresponding to the secondary position when the first control valve is under the non-operation state and when the operation member is at the second operating position, sets the pilot pressure to a third pressure corresponding to the tertiary position when the first control valve is under the operation state and when the operation member is at the first operating position.

4. The hydraulic system according to claim 3, comprising:

a proportional valve to determine the pilot pressure applied to the pressure-receiving portion of the second control valve;

an operation detector to detect any one of the first operating position and the second operating position of the operation member; and a state detector to detect any one of the non-operation state and the operation state of the first control valve, wherein the controller sets an opening aperture of the proportional valve based on any one of the first operating position and second operating position detected by the operation detector and on any one of the non-operation state and operation state detected by the state detector, and determines the first pressure, the second pressure, and the third pressure.

5. The hydraulic system according to claim 4, wherein the first pressure is higher than the third pressure, and wherein the third pressure is higher than the second pressure.

6. The hydraulic system according to claim 1, wherein the second control valve is a switching valve to be switched between the primary position, the secondary position, and the tertiary position by a pilot pressure that is a pressure of pilot fluid applied to a pressure-receiving portion of the second control valve, and wherein the controller sets the pilot pressure applied to the pressure-receiving portion to a first pressure corresponding to the primary position when the first control valve is under the non-operation state and when the operation member is at the first operating position, sets the pilot pressure to a second pressure corresponding to the secondary position when the first control valve is under the non-operation state and when the operation member is at the second operating position, sets the pilot pressure to a third pressure corresponding to the tertiary position when the first control valve is under the operation state and when the operation member is at the first operating position.

7. The hydraulic system according to claim 6, comprising:

a proportional valve to determine the pilot pressure applied to the pressure-receiving portion of the second control valve;

an operation detector to detect any one of the first operating position and the second operating position of the operation member; and a state detector to detect any one of the non-operation state and the operation state of the first control valve, wherein the controller sets an opening aperture of the proportional valve based on any one of the first operating position and second operating position detected by the operation detector and on any one of the non-operation state and operation state detected by the state detector, and determines the first pressure, the second pressure, and the third pressure.

8. The hydraulic system according to claim 6, wherein the first pressure is higher than the third pressure, and wherein the third pressure is higher than the second pressure.

9. The hydraulic system according to claim 1, wherein the first hydraulic actuator is a hydraulic cylinder capable of stretching and shortening, wherein the first control valve is a switching valve to stretch and shorten the hydraulic cylinder, and wherein the controller switches the second control valve to the tertiary position under the operation state where operation fluid is supplied to the hydraulic cylinder through the first control valve to shorten the hydraulic cylinder.

10. A hydraulic system for a working machine, comprising:

a hydraulic pump;

a first hydraulic actuator;

a second hydraulic actuator;

a first control valve to control the first hydraulic actuator;

a second control valve arranged on a downstream side of the first control valve, the second control valve being configured to control the second hydraulic actuator;

a communication fluid tube in which a return fluid flows to the second control valve, the return fluid being operation fluid discharged from the first hydraulic actuator;

a leveling control valve connected to the communication fluid tube, the leveling control valve being configured to perform a leveling operation of the second hydraulic actuator;

a return discharge fluid tube to discharge the return fluid flowing toward the second control valve on a side closer to the second control valve than a portion on which the leveling control valve is arranged in the communication fluid tube.

11. The hydraulic system according to claim 10, wherein the communication fluid tube includes:

a first return fluid tube in which the return fluid discharged from the first hydraulic actuator flows, the first return fluid tube connecting the first control valve and the first hydraulic actuator;

a bypass fluid tube connected to at least two branched portions arranged on the first return fluid tube, the bypass fluid tube having a middle portion to which the leveling control valve is connected; and a second return fluid tube in which the return fluid flows to the second control valve, the return fluid having flowed through the first return fluid tube and the first control valve, and wherein the return discharge fluid tube is connected to the second return fluid tube.

12. The hydraulic system according to claim 11, comprising a first check valve to allow the return fluid to flow from the first control valve toward the second control valve and to prevent the operation fluid from flowing from the second control valve to the return discharge fluid tube, the first check valve being arranged in the second return fluid tube.

13. The hydraulic system according to claim 12, wherein the first hydraulic actuator is a boom cylinder to move a boom, wherein the second hydraulic actuator is a bucket cylinder to move a bucket, wherein the leveling control valve is a valve to level the bucket, and wherein the first return fluid tube is a fluid tube in which the return fluid discharged from the boom cylinder flows when the boom is moved upward.

14. The hydraulic system according to claim 11, wherein the first hydraulic actuator is a boom cylinder to move a boom, wherein the second hydraulic actuator is a bucket cylinder to move a bucket, wherein the leveling control valve is a valve to level the bucket, and wherein the first return fluid tube is a fluid tube in which the return fluid discharged from the boom cylinder flows when the boom is moved upward.

15. The hydraulic system according to claim 11, comprising a second check valve arranged on a section between the branched portions of the first return fluid tube, wherein the second check valve allows the operation fluid to flow from the first control valve to the first hydraulic actuator and to prevent the operation fluid from flowing from the first hydraulic actuator to the first control valve.

16. The hydraulic system according to claim 11, comprising an operation valve arranged on a section between the branched portions of the first return fluid tube, wherein the operation valve is switched between a first state and a second state, the first state allowing the return fluid to flow to the bypass fluid tube and the leveling control valve, the return fluid having returned from the first hydraulic actuator to the first return fluid tube, to perform the leveling operation, the second state preventing the return fluid from flowing to the bypass fluid tube and the leveling control valve to stop the leveling operation.

17. The hydraulic system according to claim 10, wherein the communication fluid tube includes:

a first return fluid tube in which the return fluid discharged from the first hydraulic actuator flows, the first return fluid tube connecting the first control valve and the first hydraulic actuator;

a bypass fluid tube connected to at least two branched portions arranged on the first return fluid tube, the bypass fluid tube having a middle portion to which the leveling control valve is connected; and a second return fluid tube in which the return fluid flows to the second control valve, the return fluid having flowed through the first return fluid tube and the first control valve, and wherein the return discharge fluid tube is arranged in the first control valve.

18. The hydraulic system according to claim 17, comprising a first check valve to allow the return fluid to flow from the first control valve toward the second control valve and to prevent the operation fluid from flowing from the second control valve to the return discharge fluid tube, the first check valve being arranged in the second return fluid tube.

19. The hydraulic system according to claim 18, wherein the first hydraulic actuator is a boom cylinder to move a boom, wherein the second hydraulic actuator is a bucket cylinder to move a bucket, wherein the leveling control valve is a valve to level the bucket, and wherein the first return fluid tube is a fluid tube in which the return fluid discharged from the boom cylinder flows when the boom is moved upward.

20. The hydraulic system according to claim 17, wherein the first hydraulic actuator is a boom cylinder to move a boom, wherein the second hydraulic actuator is a bucket cylinder to move a bucket, wherein the leveling control valve is a valve to level the bucket, and wherein the first return fluid tube is a fluid tube in which the return fluid discharged from the boom cylinder flows when the boom is moved upward.

* * * * *